US009109409B2

(12) United States Patent
Childress, II et al.

(10) Patent No.: US 9,109,409 B2
(45) Date of Patent: Aug. 18, 2015

(54) SAFETY LATCH LOCK

(71) Applicant: FORUM US, INC., Houston, TX (US)

(72) Inventors: Lawrence E. Childress, II, Lafayette, LA (US); Jeremy S. Granger, Crowley, LA (US)

(73) Assignee: Forum US, Inc., Houston, TX (US)

( * ) Notice: Subject to any disclaimer, the term of this patent is extended or adjusted under 35 U.S.C. 154(b) by 339 days.

(21) Appl. No.: 13/657,400

(22) Filed: Oct. 22, 2012

(65) Prior Publication Data

US 2013/0104367 A1 May 2, 2013

Related U.S. Application Data

(60) Provisional application No. 61/553,773, filed on Oct. 31, 2011.

(51) Int. Cl.
*E21B 19/06* (2006.01)
*E21B 41/00* (2006.01)

(52) U.S. Cl.
CPC ..... *E21B 19/06* (2013.01); *E21B 41/0021* (2013.01); *Y10T 29/49826* (2015.01); *Y10T 403/595* (2015.01)

(58) Field of Classification Search
CPC ..... E21B 19/06; E21B 19/07; E21B 41/0021; Y10T 403/595
USPC ..... 294/90, 102.2
See application file for complete search history.

(56) References Cited

U.S. PATENT DOCUMENTS

| | | | | | |
|---|---|---|---|---|---|
| 1,460,652 | A | * | 7/1923 | Harris | 294/90 |
| 1,498,141 | A | * | 6/1924 | Wilson | 294/90 |
| 1,511,699 | A | * | 10/1924 | Wilcox | 294/90 |
| 1,646,981 | A | | 10/1927 | Rick | |
| 1,814,407 | A | * | 7/1931 | Peebles | 294/90 |
| 2,067,663 | A | * | 1/1937 | Grau | 294/90 |
| 2,257,120 | A | * | 9/1941 | Lundeen | 175/423 |
| 2,264,775 | A | * | 12/1941 | Spang | 294/90 |
| 2,392,462 | A | * | 1/1946 | Coe | 294/90 |
| 2,567,044 | A | * | 9/1951 | Wilson | 294/90 |
| 2,957,724 | A | * | 10/1960 | Bujold | 294/102.2 |
| 3,884,519 | A | * | 5/1975 | McFadden | 294/90 |
| 4,579,379 | A | | 4/1986 | Berg | |
| 4,898,238 | A | | 2/1990 | Grantom | |

OTHER PUBLICATIONS

International Search Report PCT application PCT/US2012/061710 dated Jan. 8, 2013 (FETI/0049 US).

* cited by examiner

*Primary Examiner* — Dean Kramer
(74) *Attorney, Agent, or Firm* — Patterson & Sheridan LLP

(57) ABSTRACT

Embodiments of the invention relate to apparatus and methods for a secondary safety device for use on elevators utilized to move casing, tubing, sucker rods, or other circular tools or members in the oil and gas industry. In one embodiment, a secondary latch lock mechanism for an elevator having a primary safety latch is provided. The secondary latch lock mechanism comprises a base portion that is fixed to a body of the elevator, and a handle movably fixed to the base portion and a first gear device by a biasing member, wherein the handle is movable to a first position proximate to the primary safety latch and a second position that is spaced away from the primary safety latch.

22 Claims, 22 Drawing Sheets

SAFETY LATCH LOCK

CROSS-REFERENCE TO RELATED APPLICATIONS

This application claims benefit of U.S. Provisional Patent Application Ser. No. 61/553,773, filed Oct. 31, 2011, which is hereby incorporated by reference herein.

BACKGROUND OF THE INVENTION

1. Field of the Invention

Embodiments of the invention generally relate to methods and apparatus for improving safety features of equipment used in the oil and gas industry. More specifically, embodiments of the invention relate to a secondary safety device for use on elevators utilized to move casing, tubing, sucker rods, or other tubular members and/or circular tools, in the oil and gas industry.

2. Description of the Related Art

An elevator is a device that is used to clamp or grip tubular members or circular tools, such as casing, tubing, drill pipe, or sucker rods, utilized in a drilling operation or rig work-over operation. A conventional elevator includes two arc-shaped members that are hingedly coupled on one end to open and close in a clamshell manner. The members may be closed to define a center hole that receives the circular tool, and opened to allow the circular tool to move into or out of the center hole. In the closed position, a primary safety latch is used to secure the free ends of the two arc-shaped members thereby preventing the two arc-shaped members from opening unexpectedly.

Primary safety latches on conventional elevators typically utilize a secondary safety mechanism to prevent the primary safety latch from opening accidently. The secondary safety mechanism may include a pin, such as a rod or a large cotter pin, that may be inserted into a hole or holes that cross the primary safety latch and prevent the primary safety latch from opening. When the elevator is to be opened, the pin is removed from the holes, which allows the primary safety latch to be positioned to allow the arc-shaped members to open.

The conventional secondary safety mechanism design has at least the following drawbacks. Use of the secondary safety mechanism typically requires the use of two hands to properly align the holes and install the pin into the holes. The hole/pin alignment and installation process may extend the time needed to properly secure the primary safety latch. Additionally, a hazardous condition is created as the operator has both hands in proximity to pinch points associated with the elevator. Further, the pin must be safely stored when not in use. Some conventional elevators include a storage hole for the pin. However, inserting the pin into the storage hole adds additional operator time. Other conventional elevators utilize a cable or small chain attached to the pin to prevent loss of the pin when not in use. However, the cable or chain may be damaged and the pin may be lost. Additionally, the cable or chain securing the pin may create a hazardous condition by potentially snagging or otherwise injuring an operator.

What is needed is an improved secondary safety lock mechanism for safely and efficiently locking a primary safety latch.

SUMMARY OF THE INVENTION

Embodiments of the present invention address the issues with conventional secondary safety mechanisms by providing a secondary latch lock mechanism that is integrated onto the elevator. The inventive secondary latch lock mechanism as described herein may be operated with one hand and is coupled to the elevator, which prevents loss of the secondary latch lock mechanism as well as providing additional safety to personnel.

In one embodiment, a secondary latch lock mechanism for an elevator having a primary safety latch is provided. The secondary latch lock mechanism comprises a base portion that is fixed to a body of the elevator, and a handle movably fixed to the base portion and a first gear device by a biasing member, wherein the handle is movable to a first position proximate to the primary safety latch and a second position that is spaced away from the primary safety latch.

In another embodiment, a secondary latch lock mechanism for an elevator having a primary safety latch is provided. The secondary latch lock mechanism comprises a base portion that is fixed to a body of the elevator, and a handle movably fixed to the base portion, wherein the handle is selectively engaged with a first gear device disposed on a first side of the base portion, and a second gear device disposed on an opposing second side of the base portion.

In another embodiment, a method for selectively securing a primary safety latch coupled to an elevator is provided. The method comprises moving the primary safety latch from an open position to a closed position, moving a handle coupled to the elevator to a first position proximate a first surface of the primary safety latch, the first position preventing the primary safety latch from moving to the open position, and moving the handle to a second position that is spaced away from the first surface of the primary safety latch, the second position allowing movement of the primary safety latch to the open position.

BRIEF DESCRIPTION OF THE DRAWINGS

So that the manner in which the above recited aspects of the invention can be understood in detail, a more particular description of embodiments of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
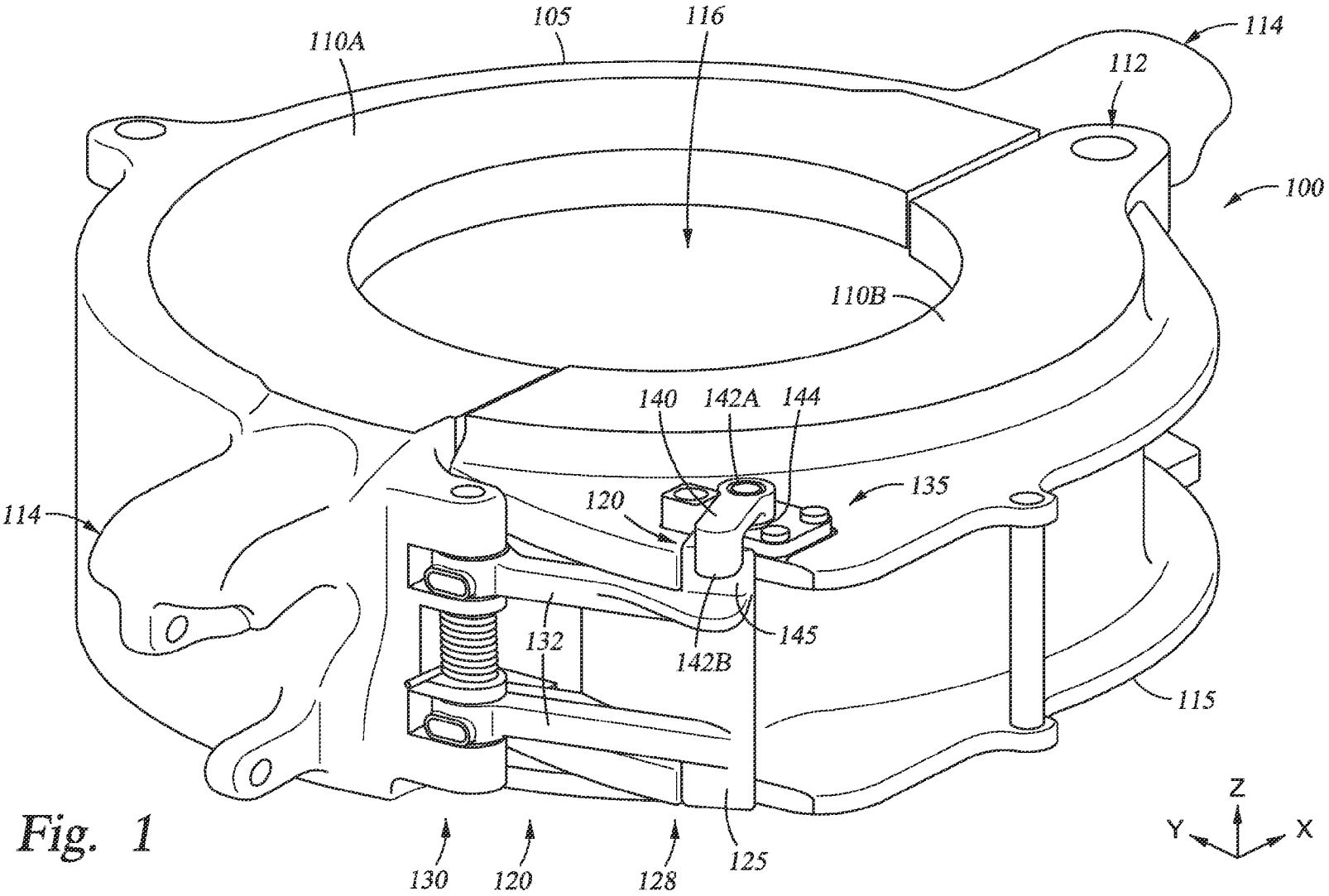
FIG. 1 is an isometric view of an elevator having a secondary latch lock mechanism according to embodiments of the invention.

To facilitate understanding, identical reference numerals have been used, where possible, to designate identical elements that are common to the figures. It is also contemplated that elements and features of one embodiment may be beneficially incorporated on other embodiments without further recitation.

DETAILED DESCRIPTION

FIG. 1 is an isometric view of an elevator 100 showing one embodiment of the invention. The elevator 100 includes a body 105 having two members 110A and 1108 that are coupled at one end by a hinge device 112. The body 105 includes two hooks 114 adapted to receive a bail that is coupled to a travelling block (both are not shown). The member 1108 may be configured as a door 115 that may be closed, as shown in FIG. 1, to define a center hole 116 that clamps a tool (not shown), such as casing, tubing, drill pipe, or sucker rods, utilized in a drilling operation or rig work-over operation. The door 115 may be selectively opened to allow passage of the tool into and out of the center hole 116 of the elevator 100.

In the closed position, the door 115 is secured by a primary latch mechanism 120. The primary latch mechanism 120 comprises a latch plate 125 that is positioned proximate to one or more wedge-shaped latch members 128 in the closed position. The latch members 128 may be formed on the member 1108. The latch plate 125 is secured to the member 110A by a hinge device 130. One or more support members 132 may be used to couple the latch plate 125 to the hinge device 130. The hinge device 130 allows the latch plate 125 to move in an arc relative to the member 110A and toward and away from the member 1108. However, as shown in FIG. 1, the latch plate 125 is prevented from moving by a secondary latch lock mechanism 135 coupled to the member 1108.

The secondary latch lock mechanism 135 comprises a handle 140 having a proximal end 142A and an enlarged distal end 142B. The enlarged distal end 142B may comprise a post-like projection extending orthogonally from the handle 140. The secondary latch lock mechanism 135 also includes an indexer or gear device 144 that selectively locks the handle 140 in a closed position such that the distal end 142B of the handle 140 is positioned proximate a surface 145 of the latch plate 125 in the closed position. As shown in FIG. 1, the secondary latch lock mechanism 135 prevents the latch plate 125 from moving away from the door 115 (or member 110B) as the distal end 142B of the handle 140 is in proximity to the surface 145 of the latch plate 125. As will be explained in greater detail below, the handle 140 is movable from the closed position to an open position (not shown) by lifting the handle 140 upwards (Z direction). Lifting the handle 140 disengages the handle 140 from the gear device 144 and allows rotation of the handle 140. In operation, personnel may lift the handle 140 with one hand, which disengages the handle from the gear device 144, and the handle 140 may be rotated away from the latch plate 125. When the distal end 142B of the handle 140 is clear of the latch plate 125, the latch plate 125 may be moved away from the door 115 and the door 115 may be opened.

Figure 2:
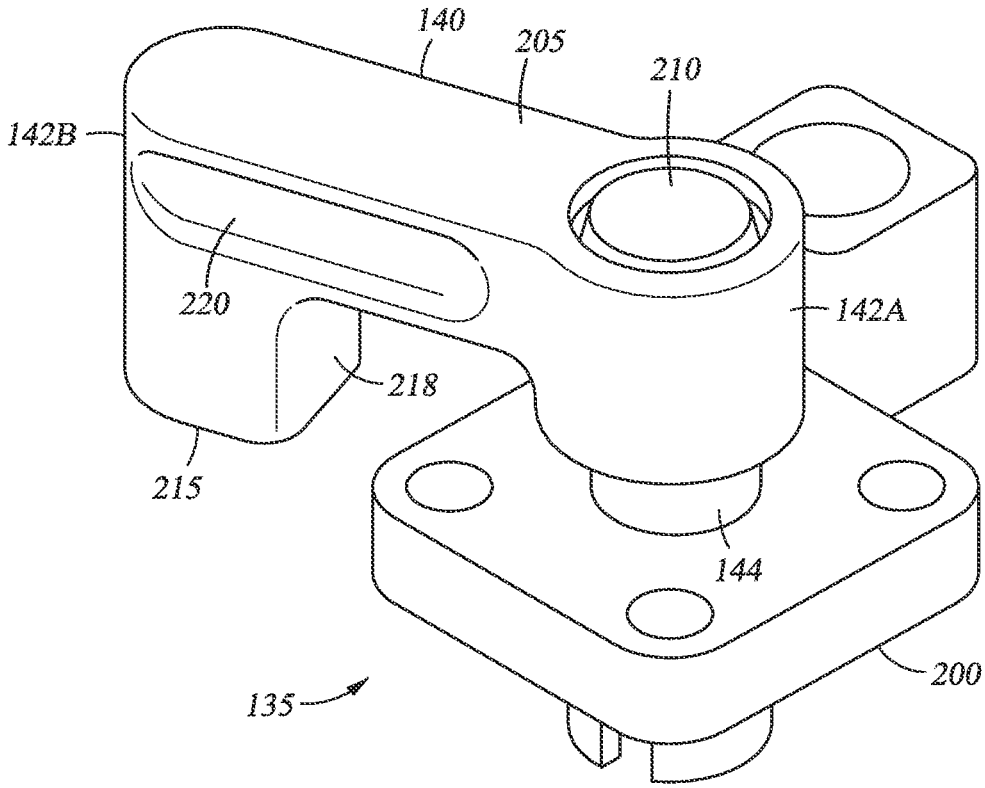
FIG. 2 is an isometric view of the secondary latch lock mechanism of FIG. 1.

FIG. 2 is an isometric view of the secondary latch lock mechanism 135 of FIG. 1. The handle 140 is coupled to a base 200. The base 200 may be coupled to the door 115 (shown in FIG. 1) by fasteners, such as screws or bolts, welding, or other suitable fastening method. The handle 140 includes a body 205 having an opening formed in the proximal end 142A that receives a spindle 210. One or both of the handle and the spindle 210 may be coupled with the gear device 144. The distal end 142B also includes a protruded portion 215 that extends from the body 205. The protruded portion 215 may include a flat face 218 that faces the proximal end 142A. The flat face 218 may be substantially normal (i.e., about 85 degrees to about 95 degrees) to the longitudinal axis of the body 205. The body 205 may also include a gripping feature 220, such as a raised rib or a depressed channel, formed in the body 205 to assist gripping of the handle 140 during opening and/or closing operations.

Figure 3A:
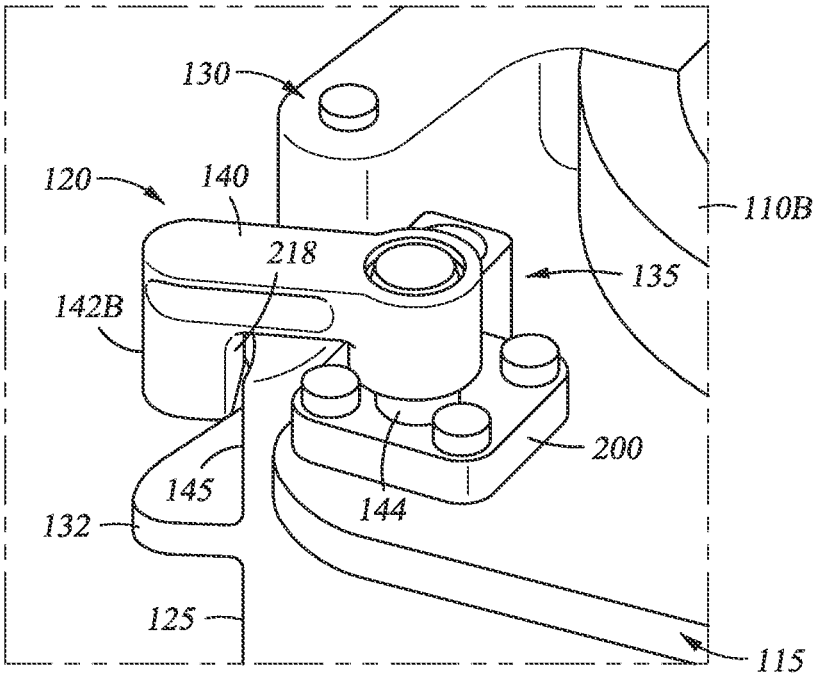
FIG. 3A is an isometric view of a primary latch mechanism and the secondary latch lock mechanism of FIG. 2 in a closed position.
Figure 3B:
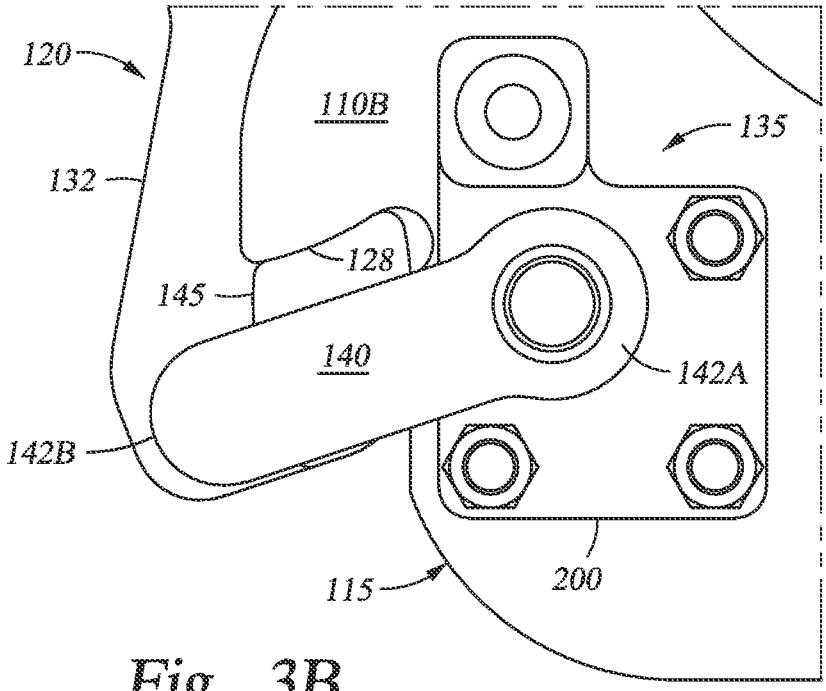
FIG. 3B is a top view of the primary latch mechanism and the secondary latch lock mechanism of FIG. 3A.
Figure 4A:
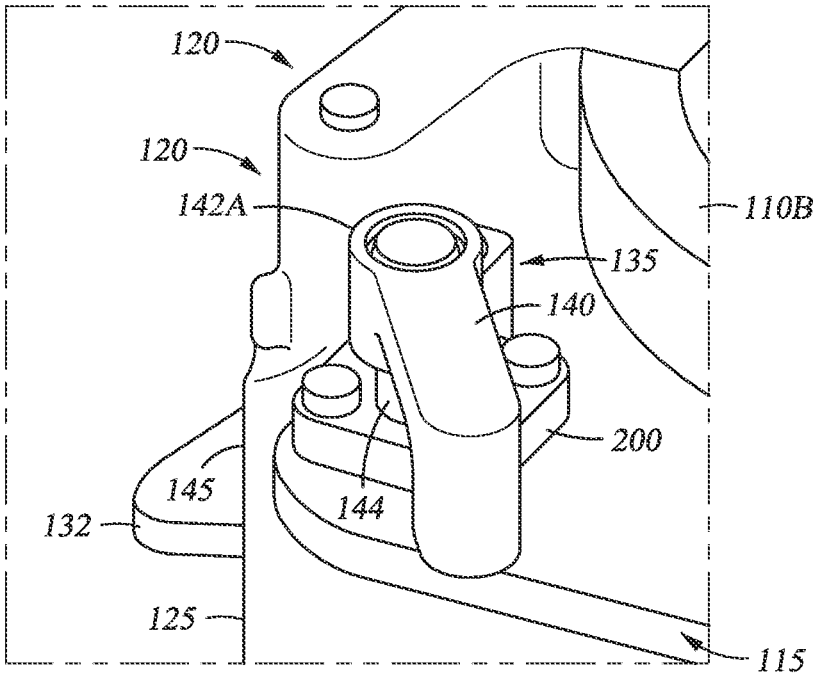
FIG. 4A is an isometric view of the primary latch mechanism in a closed position and the secondary latch lock mechanism of FIG. 2 in an open position.
Figure 4B:
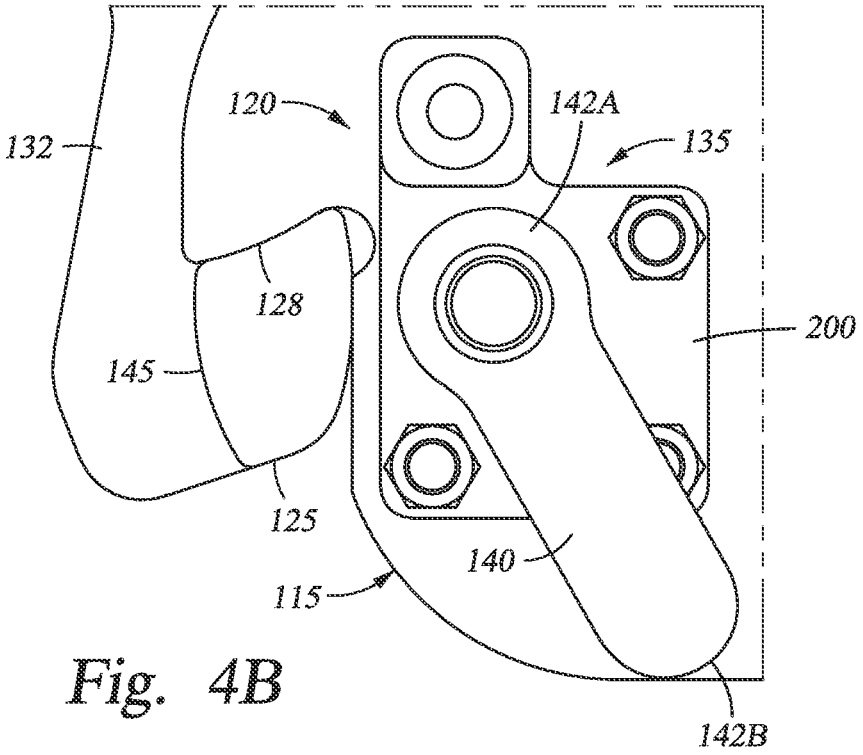
FIG. 4B is a top view of the primary latch mechanism and the secondary latch lock mechanism of FIG. 4A.

FIG. 3A is an isometric view of the primary latch mechanism 120 and the secondary latch lock mechanism 135 in a closed position. FIG. 3B is a top view of the primary latch mechanism 120 and the secondary latch lock mechanism 135 in the closed position. FIG. 4A is an isometric view of the primary latch mechanism 120 in a closed position and the secondary latch lock mechanism 135 in an open position. FIG. 4B is a top view of the primary latch mechanism 120 in a closed position and the secondary latch lock mechanism 135 in the open position. As shown in FIGS. 4A and 4B, the latch plate 125 may be free to move relative to the door 115 when the handle 140 is in the open position.

Figure 5:
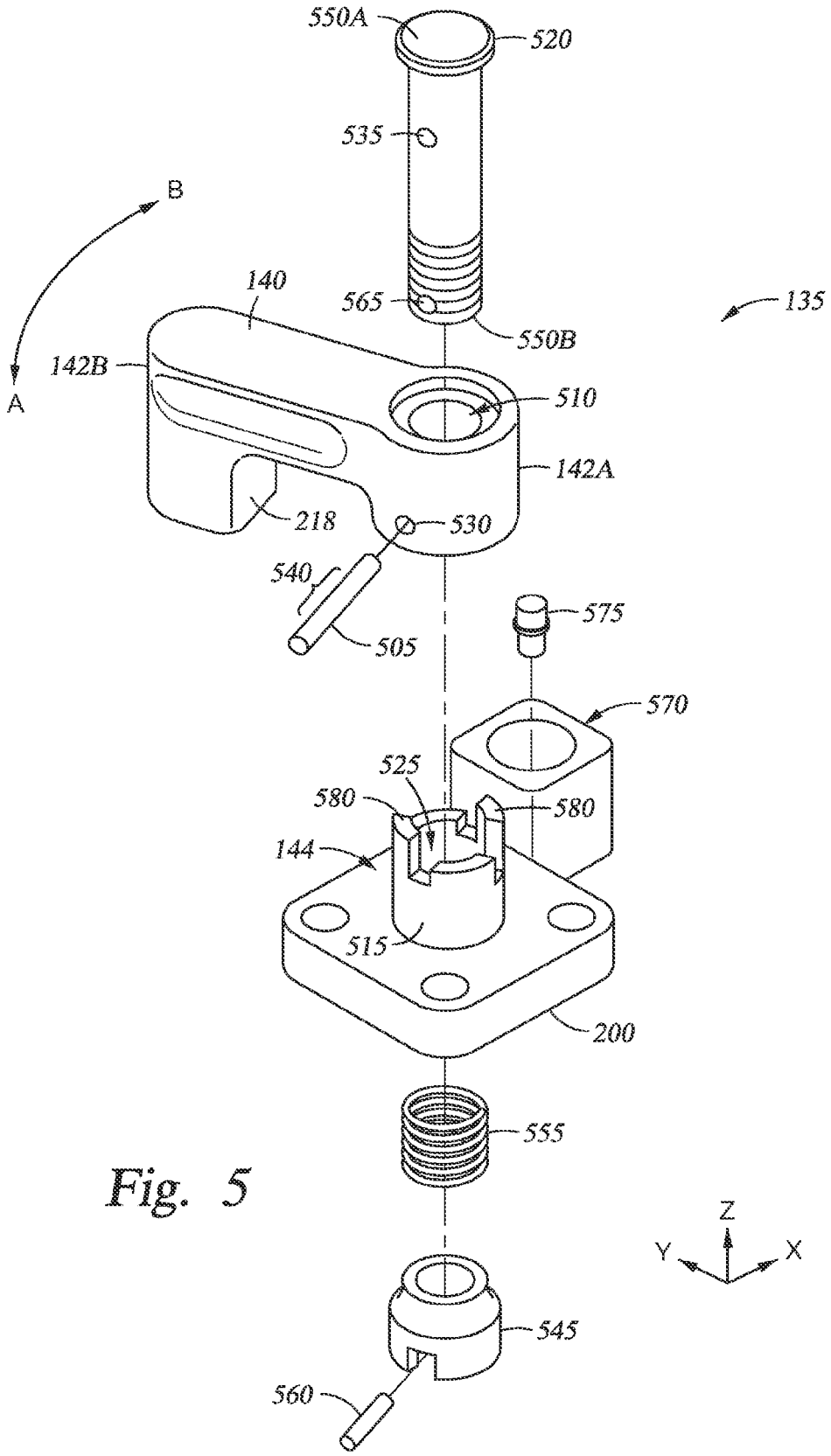
FIG. 5 is an exploded view of the secondary latch lock mechanism of FIGS. 2-4B.

FIG. 5 is an exploded view of the secondary latch lock mechanism 135 of FIGS. 1-4B. A gear device 144 is shown on the base 200. The gear device 144 comprises a plurality of teeth that selectively engage with a pin 505 that is disposed in the proximal end 142A of the handle 140. An opening 510 formed in the proximal end 142A of the handle 140 is sized to receive an outer surface 515 of the gear device 144 as well as a spindle, which may comprise a fastener 520. The fastener 520 includes a first end 550A and a second end 550B. The first end 550A may include an enlarged head portion to prevent the fastener 520 from completely going through the opening 510 in the handle 140. The fastener 520 includes an outside dimension that fits within an opening 525 of the gear device 144. The pin 505 is secured to the handle 140 by an opening 530 formed substantially normal to the axis of the opening 510 in the proximal end 142A of the handle 140. The pin 505 is also secured to the fastener 520 at a first through-hole 535 formed proximate the first end 550A substantially normal to a longitudinal axis of the fastener 520. A region 540 of the pin 505 is received in the first through-hole 535 of the fastener 520 when assembled. Regions of the pin 505 outside of the region 540 are exposed to upper surfaces (i.e., toothed portions) the gear device 144 on opposing sides of the fastener 520 when assembled. A retainer device 545 may be coupled to the second end 550B of the fastener 520. A biasing member 555, such as a spring, may be positioned between the retainer device 545 and the bottom surface of the gear device 144. The biasing member 555 is utilized to maintain a tensional force on the fastener 520, and ultimately the handle 140, to facilitate engagement of the pin 505 and the gear device 144. The second end 550B of the fastener 520 may be threaded to facilitate attachment of the retainer device 545 thereon. Alternatively or additionally, a pin 560 may be received in a second through-hole 565 formed proximate the second end 550B and substantially normal to a longitudinal axis of the fastener 520 in order to secure the retainer device 545 to the fastener 520. The secondary latch lock mechanism 135 may also include a lubricating port 570, which may comprise internal fluid distribution channels (not shown) and a grease fitting 575 for facilitating lubrication of the secondary latch lock mechanism 135.

In one aspect, when the secondary latch lock mechanism 135 is assembled, teeth 580 of the gear device 144 engage the regions of the pin 505 to prevent movement of the handle 140 in a first direction A (i.e., a counterclockwise direction) while the handle 140 is biased toward the base 200 by the biasing member 555. Thus, the force of the biasing member 555 must be overcome by lifting the handle 140 relative to the base 200 (in the Z direction) to move the handle 140 from a closed position as shown in FIGS. 3A and 3B to an open position as shown in FIGS. 4A and 4B. The gear device 144 may also engage the pin 505 to prevent movement of the handle in a second direction B (i.e., a clockwise direction) in a similar manner. However, the gear device 144 may be configured to rotate with minimal lifting force applied to the handle 140 in at least one direction. For example, the teeth 580 of the gear device 144 may be configured to allow the handle 140 to rotate in the second direction B with minimal to no lifting force applied to the handle 140. In this example, second direction B may be a closed position and the gear device 144 is configured to allow the handle 140 to be easily rotated to the closed position. However, the gear device 144 may be configured to limit movement from the closed position to the open position (i.e., limit movement in the first direction A), requiring the handle to be positively lifted and rotated by personnel before disengagement with the teeth 580 of the gear device 144.

Figure 6A:
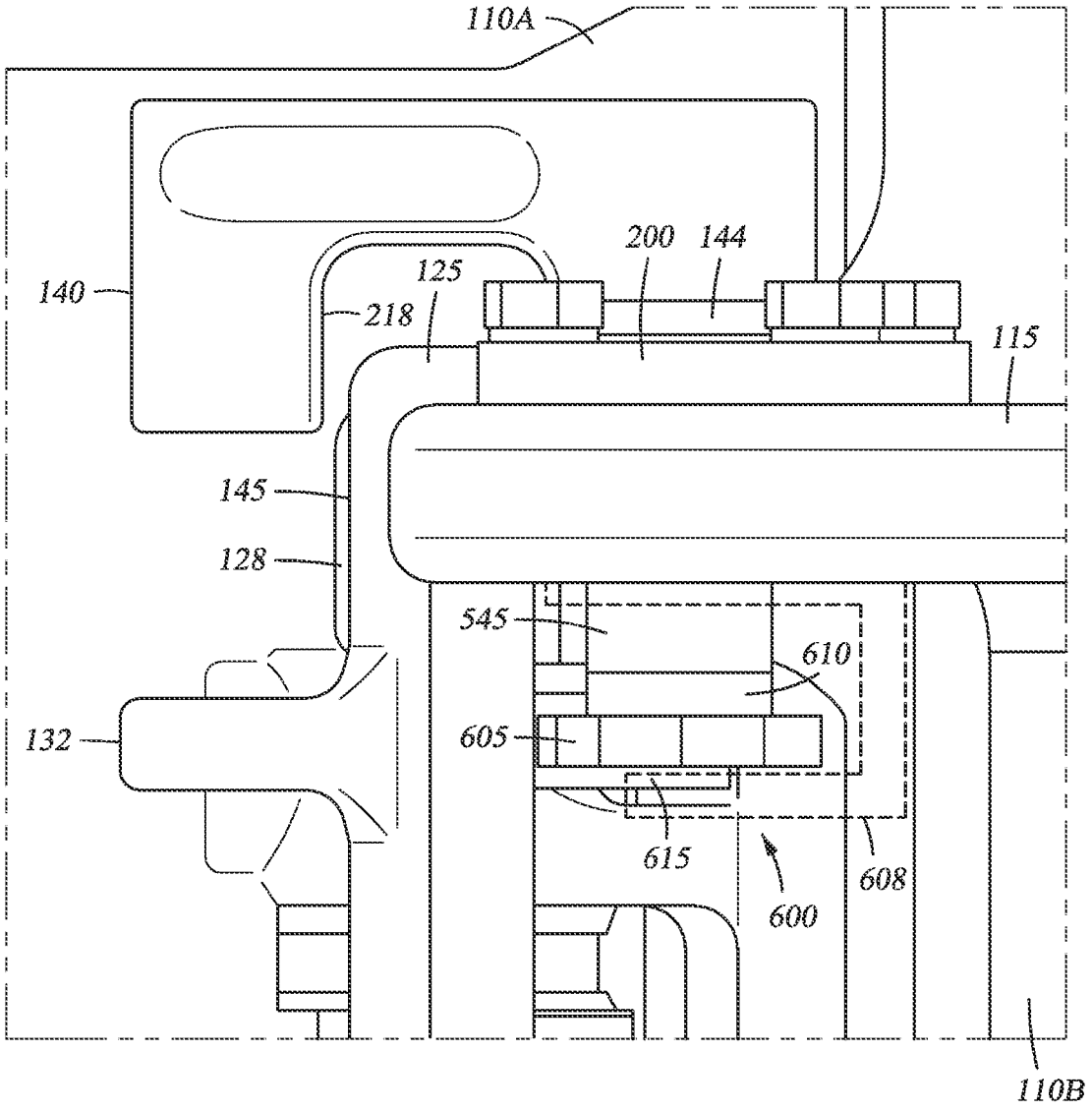
FIGS. 6A and 6B are schematic views depicting another embodiment of a secondary latch lock mechanism that may be utilized with the elevator of FIG. 1.
Figure 6B:
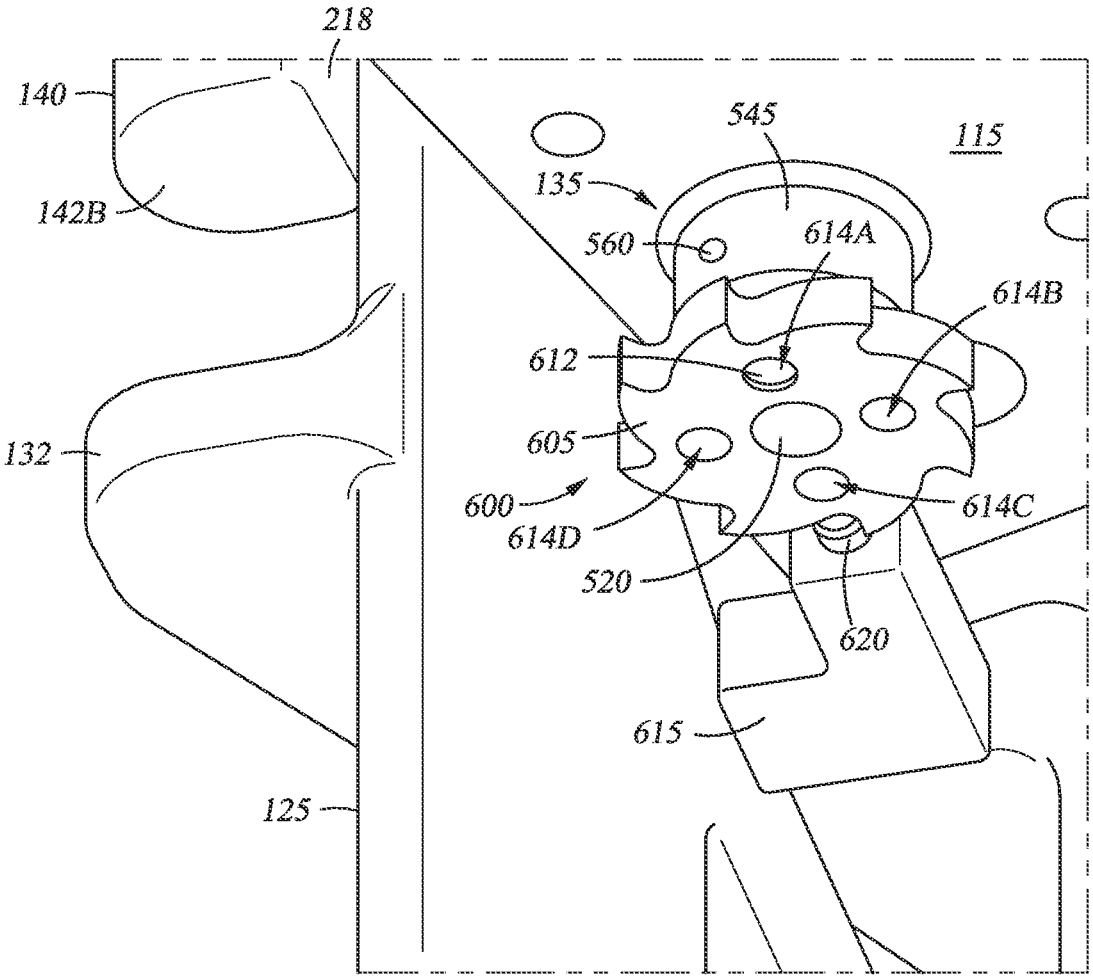

FIGS. 6A and 6B are schematic views depicting another embodiment of a secondary latch lock mechanism 135. In this embodiment, an automated safety latch lock mechanism 600 is used in conjunction with the secondary latch lock mechanism 135 described in FIGS. 1-5. FIG. 6A is a side view of the automated safety latch lock 600 and FIG. 6B an isometric bottom view of the automated safety latch lock mechanism 600. The automated safety latch lock 600 is shown in a closed position in both of FIGS. 6A and 6B.

The automated safety latch lock 600 comprises a sprocket 605 that is coupled to a housing 608 (shown in phantom in FIG. 6A) that is coupled to the door 115. The housing 608 maintains the sprocket 605 in a stable position relative to the door 115 while allowing the sprocket 605 to rotate. The sprocket 605 is coupled to the handle 140 by a lower gear 610 having a pin 612 that selectively engages holes 614A-614D formed in the sprocket 605. In FIG. 6B, the pin 612 is disposed in a first hole 614A. A striker device 615 is coupled to the housing 608 (not shown in FIG. 6B) that the sprocket 605 is mounted to. The striker device 615 includes a movable pin 620 that engages teeth of the sprocket 605. FIGS. 7A-8B follow to describe an opening sequence of the secondary latch lock mechanism 135 according to this embodiment.

Figure 7A:
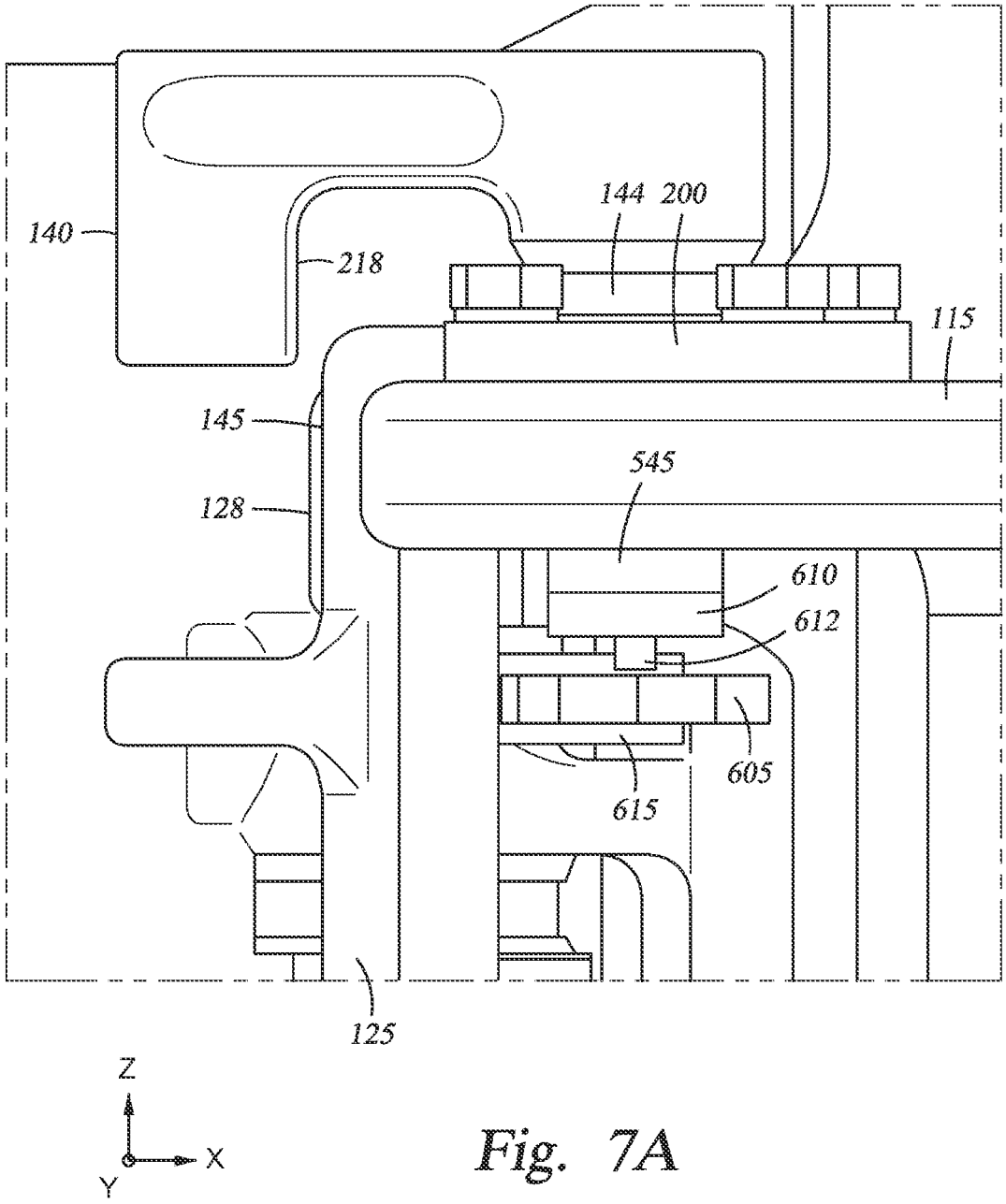
FIGS. 7A-8B are various views to describe an opening sequence of the secondary latch lock mechanism of FIGS. 6A and 6B.
Figure 7B:
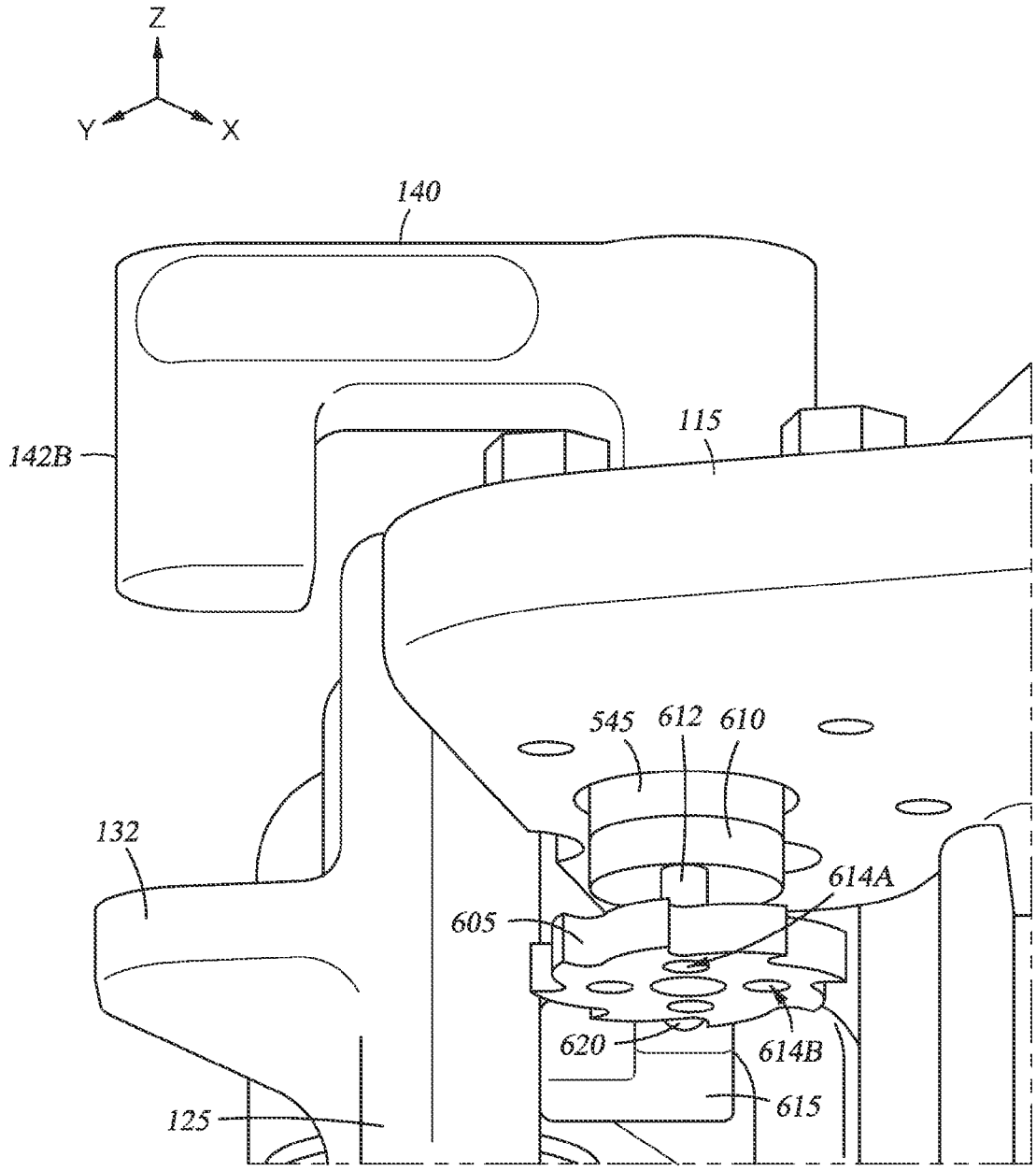

FIG. 7A is a side view of the secondary latch lock mechanism 135 having the automated safety latch lock 600 shown in FIGS. 6A and 6B. FIG. 7B is an isometric view of the automated safety latch lock 600 of FIG. 7A. The housing 608 is not shown in these views in order to more clearly show the sprocket 605. As shown in FIGS. 7A and 7B, the handle 140 is lifted (in the Z direction), which raises the gear 610 relative to the sprocket 605. The gear 610 is moved relative to the sprocket 605 to a position that removes the pin 612 from engagement with holes in the sprocket 605. In particular, the pin 612 is raised out of engagement with hole 614A of the sprocket 605. During the raising of the handle 140, the sprocket 605 is stationary due to a bias against the sprocket 605 provided by the movable pin 620. When the handle 140 is raised and the pin 612 is disengaged from the hole 614A, the handle 140, the lower gear 610, the pin 612, and the retainer device 545 may be rotated relative to the sprocket 605 which remains stationary during this process.

Figure 8A:
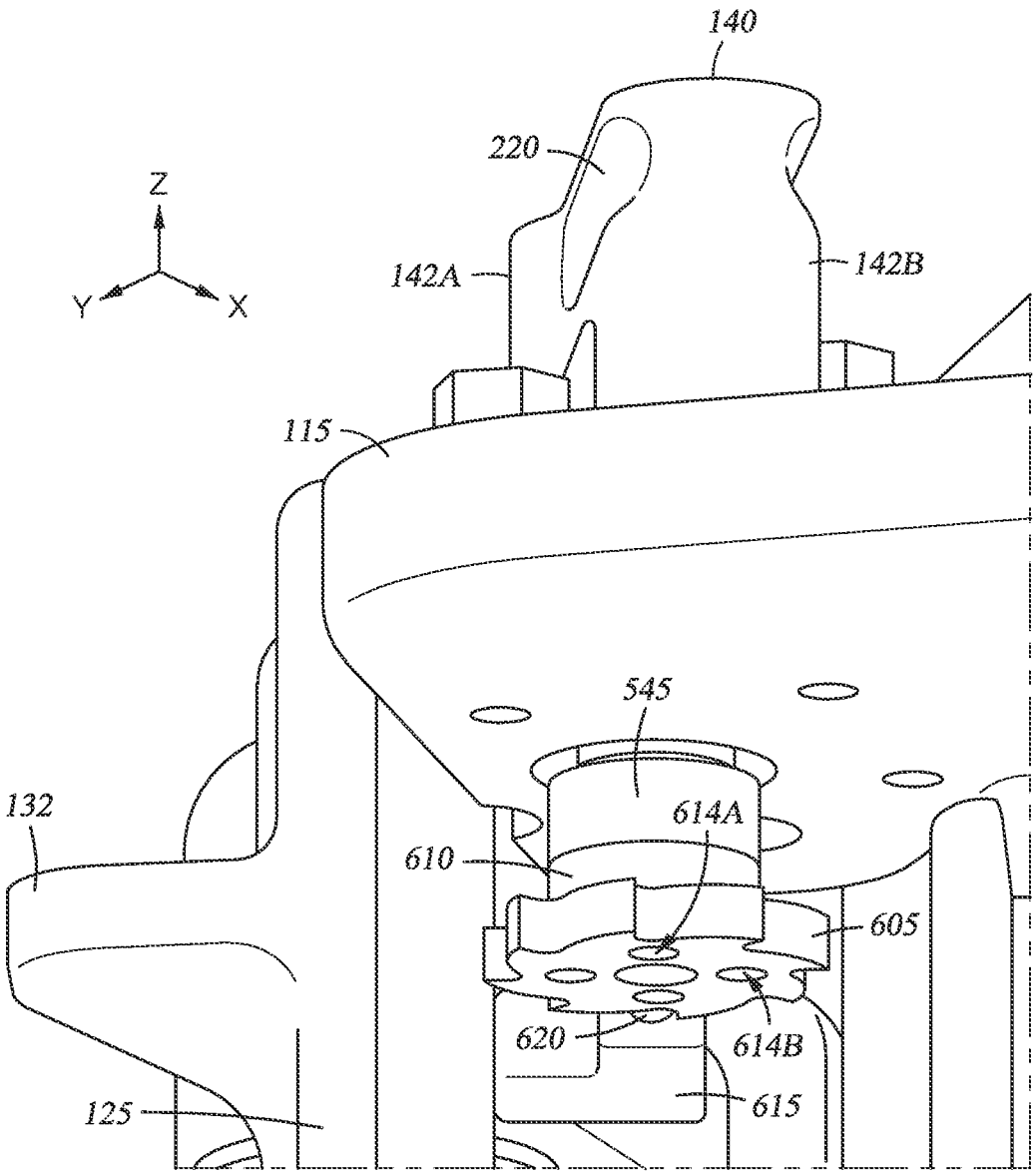
Figure 8B:
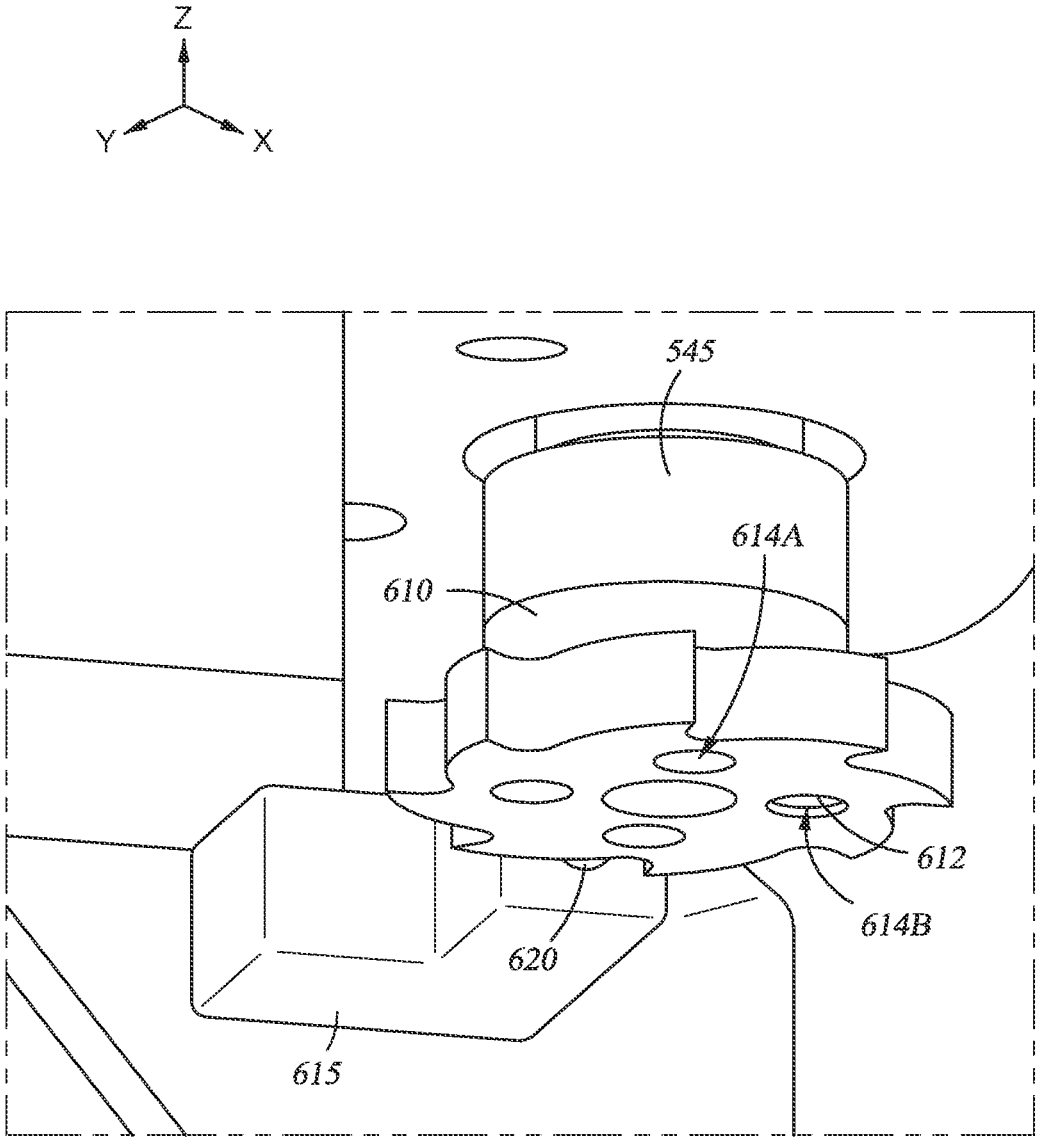

FIGS. 8A and 8B show the handle 140 rotated to an open or unlocked position. The handle 140 may be turned in a counterclockwise direction until the pin 612 is aligned with a second hole 614B on the sprocket 605. Lifting of the handle 140 during this rotation is not required and the pin 612 remains biased toward a surface of the sprocket 605 by the biasing member 555 (shown in FIG. 5). During the rotation of the handle 140, and portions coupled thereto, such as the lower gear 610, the pin 612, and the retainer device 545, the sprocket 605 remains stationary. About a 90 degree rotation of the handle 140 allows the pin 612 to be reengaged with the sprocket 605, but in a second hole 614B of the sprocket 605, as shown in FIG. 8B.

Figure 9:
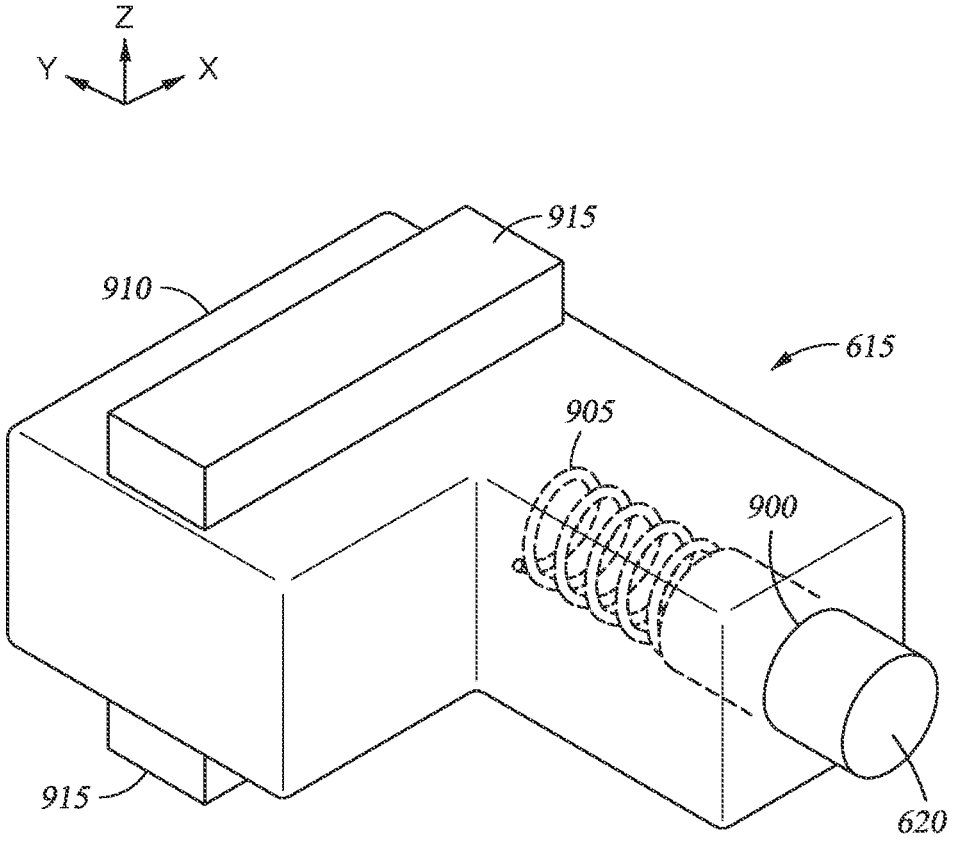
FIG. 9 is an isometric view of one embodiment of a striker device that may be used with the secondary latch lock mechanism shown in FIGS. 6A-8B.

FIG. 9 is an isometric view of one embodiment of a striker device 615 that may be used with the secondary latch lock mechanism 135 shown in FIGS. 6A-8B. The striker device 615 includes an opening 900 for the movable pin 620. A biasing member 905, such as a spring, may be disposed in a body 910 of the striker device 615 to bias the movable pin 620 outward of the body 910 (i.e., in the X direction). The striker device 615 also includes one or more indexing features 915 that are configured as a structure facilitating linear movement of the body 910. The indexing features 915 may be in the form of a protruded shoulder configured to mate with another structure in the housing 608 (not shown) to facilitate linear movement of the striker device 615 relative to the housing 608.

Figure 10:
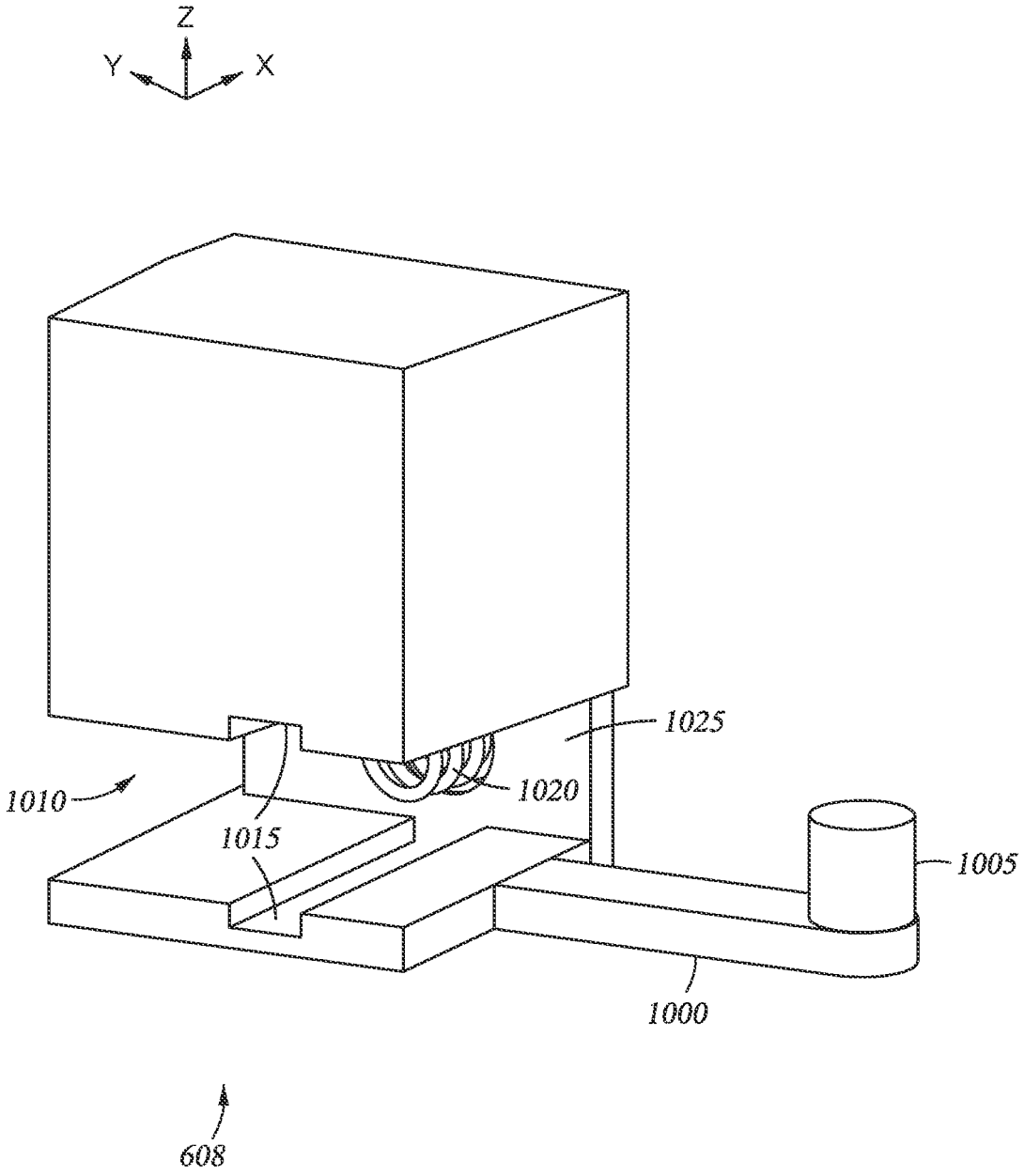
FIG. 10 is an isometric view of one embodiment of a housing that may be used with the secondary latch lock mechanism shown in FIGS. 6A-8B.
Figure 11:
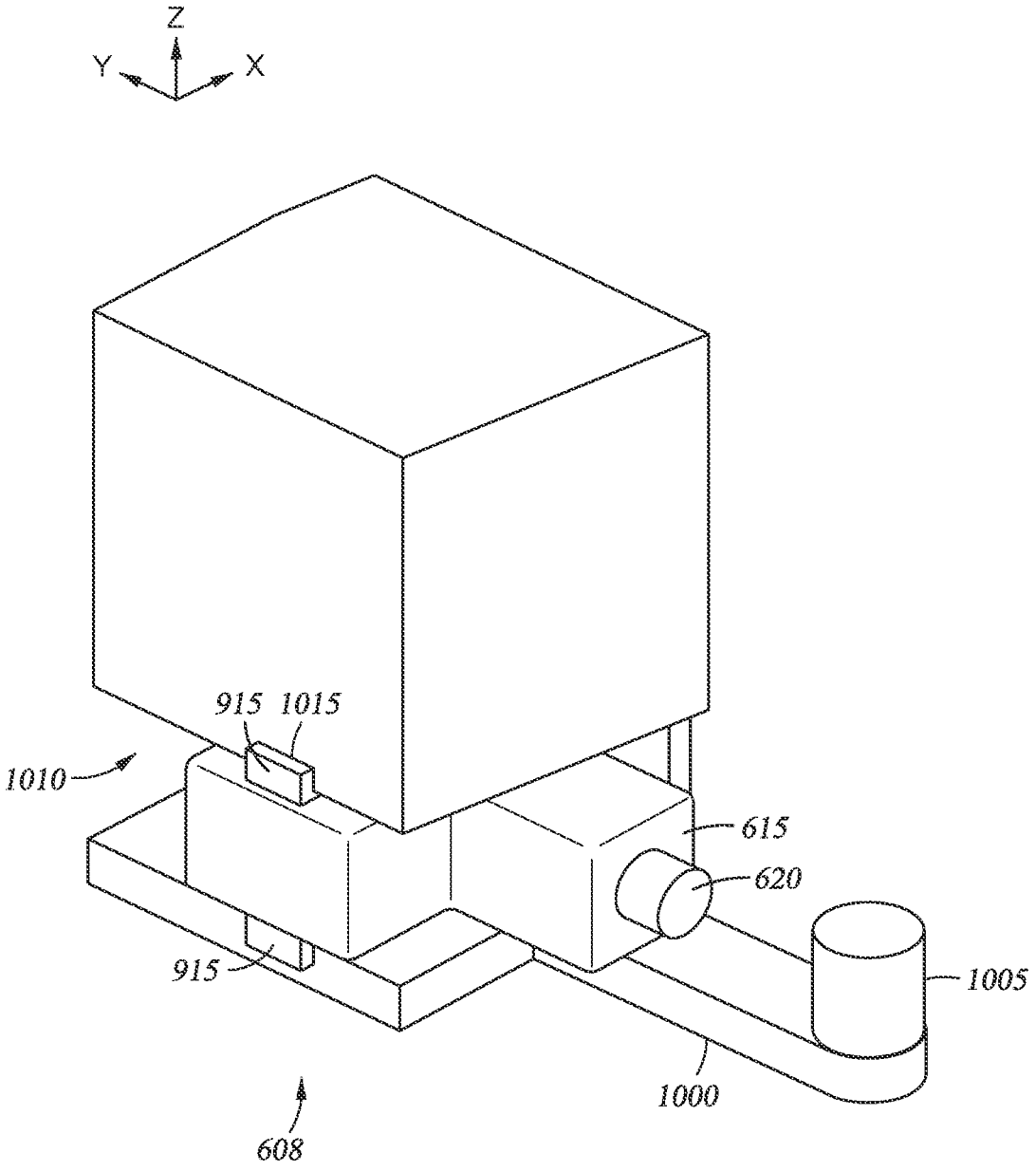
FIG. 11 is an isometric view of one embodiment of the striker device of FIG. 9 assembled in the housing of FIG. 10.

FIG. 10 is an isometric view of one embodiment of a housing 608 that may be used with the secondary latch lock mechanism 135 shown in FIGS. 6A-8B. The housing 608 includes an axle 1000 having a spindle 1005 that facilitates retention of the sprocket 605 (shown in FIGS. 6A-8B). The housing 608 may also include a recess 1010 having one or more channels 1015 that mate with indexing features 915 of the striker device 615 (shown in FIG. 9). A biasing member 1020, such as a spring, may be coupled to a wall 1025 of the housing 608. The biasing member 1020 is utilized to bias the body 910 of the striker device 615 (shown in FIG. 9) in the Y direction. FIG. 11 is an isometric view of one embodiment of the striker device 615 of FIG. 9 assembled in the housing 608 of FIG. 10.

Figure 12:
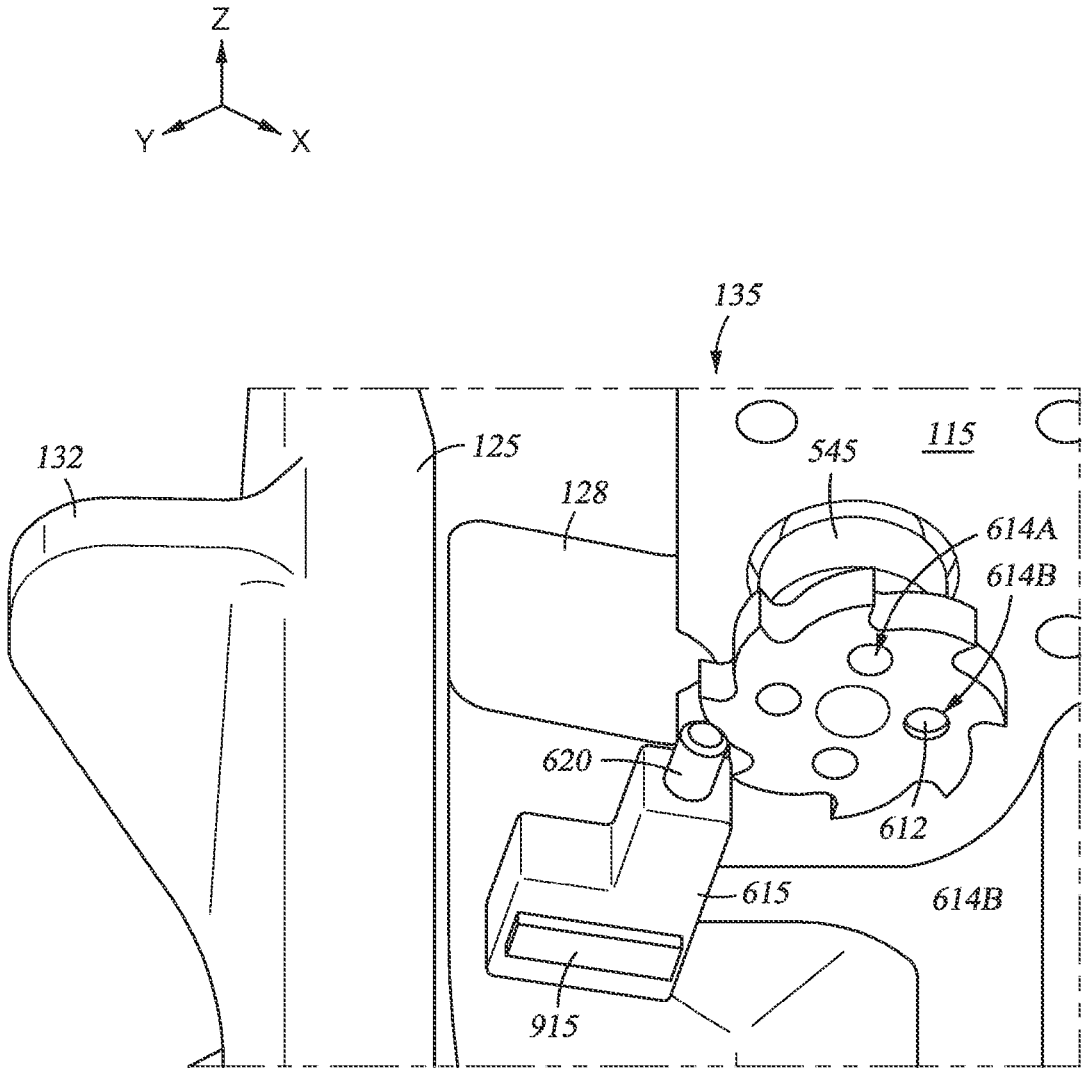
FIG. 12 is an isometric bottom view of the secondary latch lock mechanism of FIGS. 6A-8B.

FIG. 12 shows the secondary latch lock mechanism 135 in an open position and the latch plate 125 moved a distance away from the door 115. The striker device 615 is coupled to the housing 608 (not shown for clarity) that allows lateral movement of the striker device 615 relative to the sprocket 605. In this opened (unlatched) position, the sprocket 605 and handle 140 (not seen in this view) do not move. Movement of the latch plate 125 away from the door 115 allows the striker device 615 to move laterally (in a direction toward the latch plate 125 (in the Y direction)). The movable pin 620 moves past teeth of the sprocket 605 during this lateral movement of the striker device 615 due to the shape of the teeth. The movable pin 620 is coupled to a biasing member 905 (shown in FIG. 9) that biases the movable pin 620 toward the sprocket 605. In the position shown in FIG. 12, the movable pin 620 is fully extended. In this position, the latch plate 125 may be opened and the door 115 may be opened for entry or exit of circular tools. The secondary latch lock mechanism 135 and the striker device 615 (via the housing 608 (not shown)) stays coupled to the door 115 during loading or unloading. The opening process requires only lifting and rotation of the handle 140, which may be accomplished with one hand. Further, all parts of the secondary latch lock mechanism 135 are securely coupled to the door 115, requiring no removal of parts which are stored or otherwise bothersome to personnel. Further, the position of the striker device 615 shown in FIG. 12 is readied for closing which is explained in FIG. 13.

Figure 13:
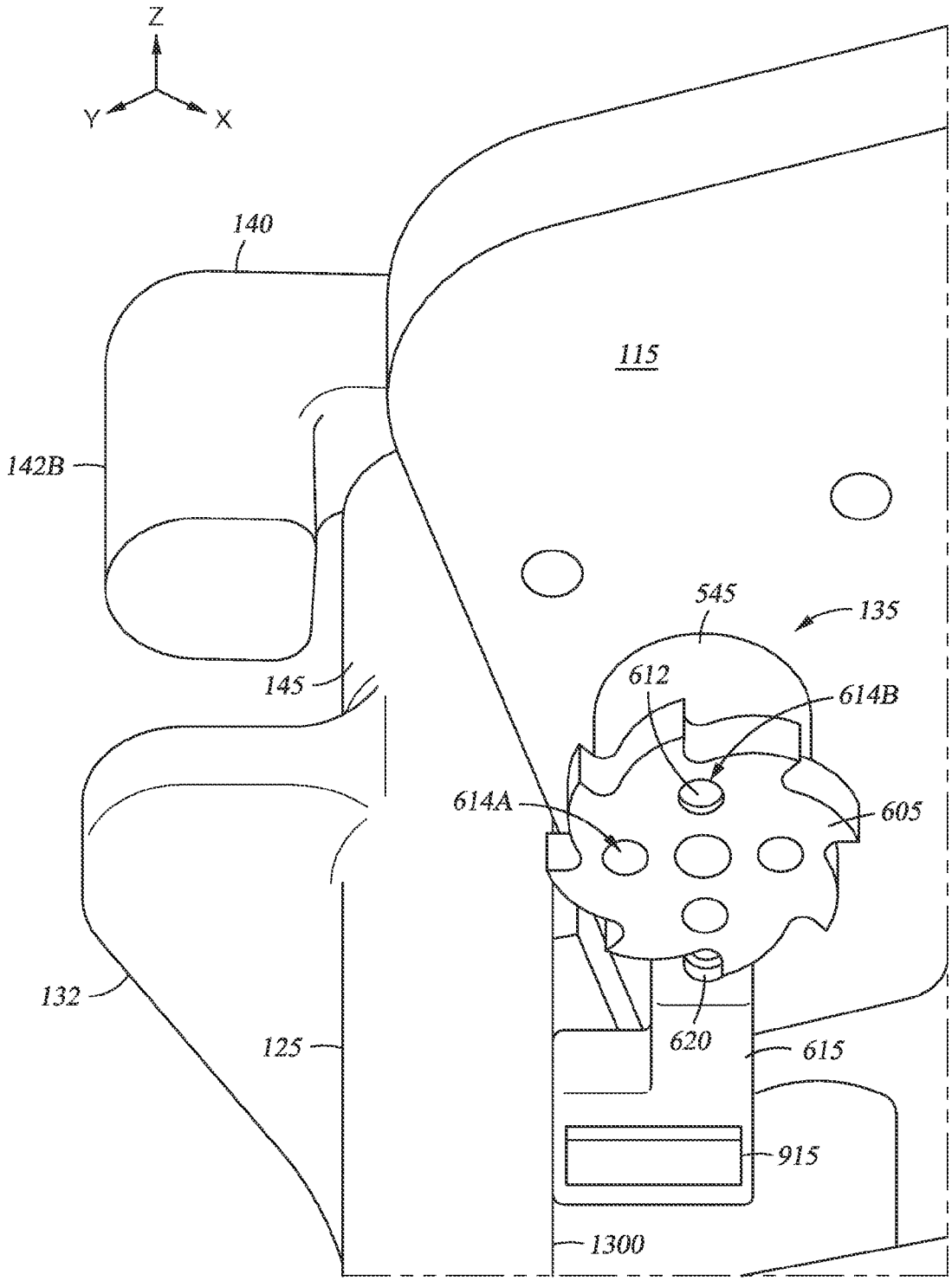
FIG. 13 is an isometric view of the secondary latch lock mechanism of FIG. 12 during closing of a latch plate.

FIG. 13 is an isometric view of the secondary latch lock mechanism 135 during closing of the latch plate 125. During closing, an inner surface 1300 of the latch plate 125 contacts a side 1305 of the striker device 615, which causes the striker device 615 to move laterally away from the latch plate 125 (in the Y direction). This causes the movable pin 620 to engage a tooth of the sprocket 605 and turn the sprocket 605 in a counterclockwise direction. As the sprocket 605 is engaged with the pin 612, and the pin 612 is coupled to the handle 140 via the lower gear 610 and the retainer device 545, the handle 140 is caused to rotate in a counterclockwise direction in a position that hinders movement of the latch plate 125.

Figure 14:
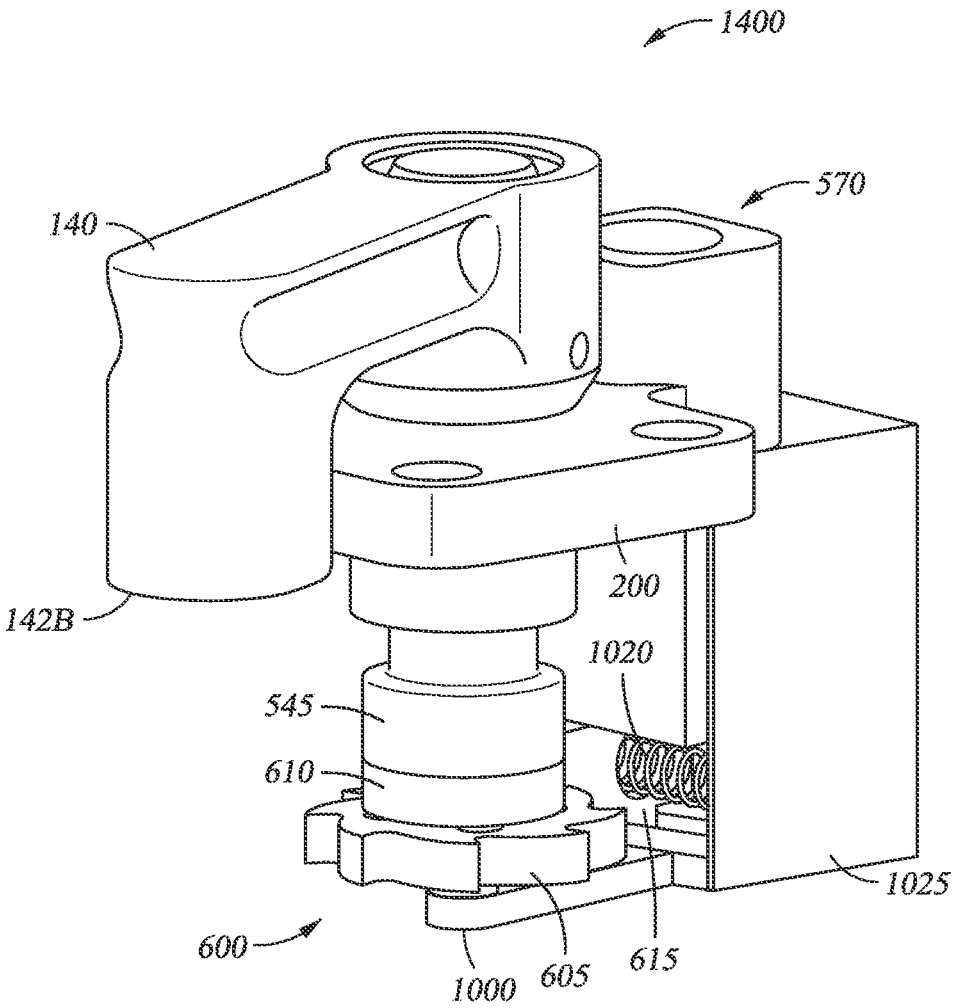
FIG. 14 is an isometric view of one embodiment of a secondary latch lock assembly that may be used with the elevator of FIG. 1.

FIG. 14 is an isometric view of one embodiment of a secondary latch lock assembly 1400 that may be used with the elevator 100 of FIG. 1. The assembly 1400 incorporates the housing 608 and the base 200 of the secondary latch lock mechanism 135 as an integral unit that may be coupled to the elevator 100 (not shown) by fasteners (also not shown).

Figure 15A:
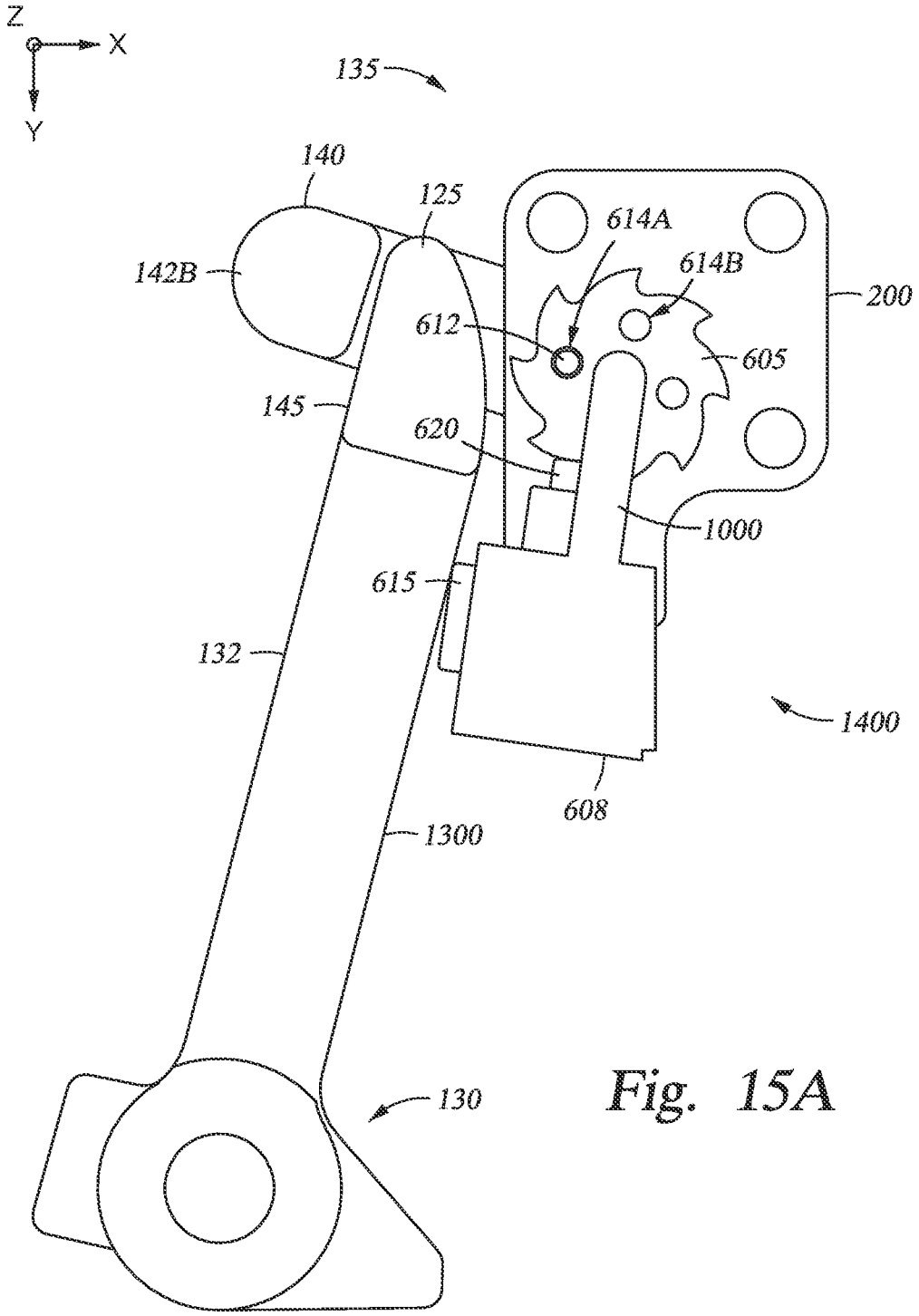
FIGS. 15A-15C are bottom views of the secondary latch lock assembly of FIG. 14 depicting a latch opening sequence.
Figure 15B:
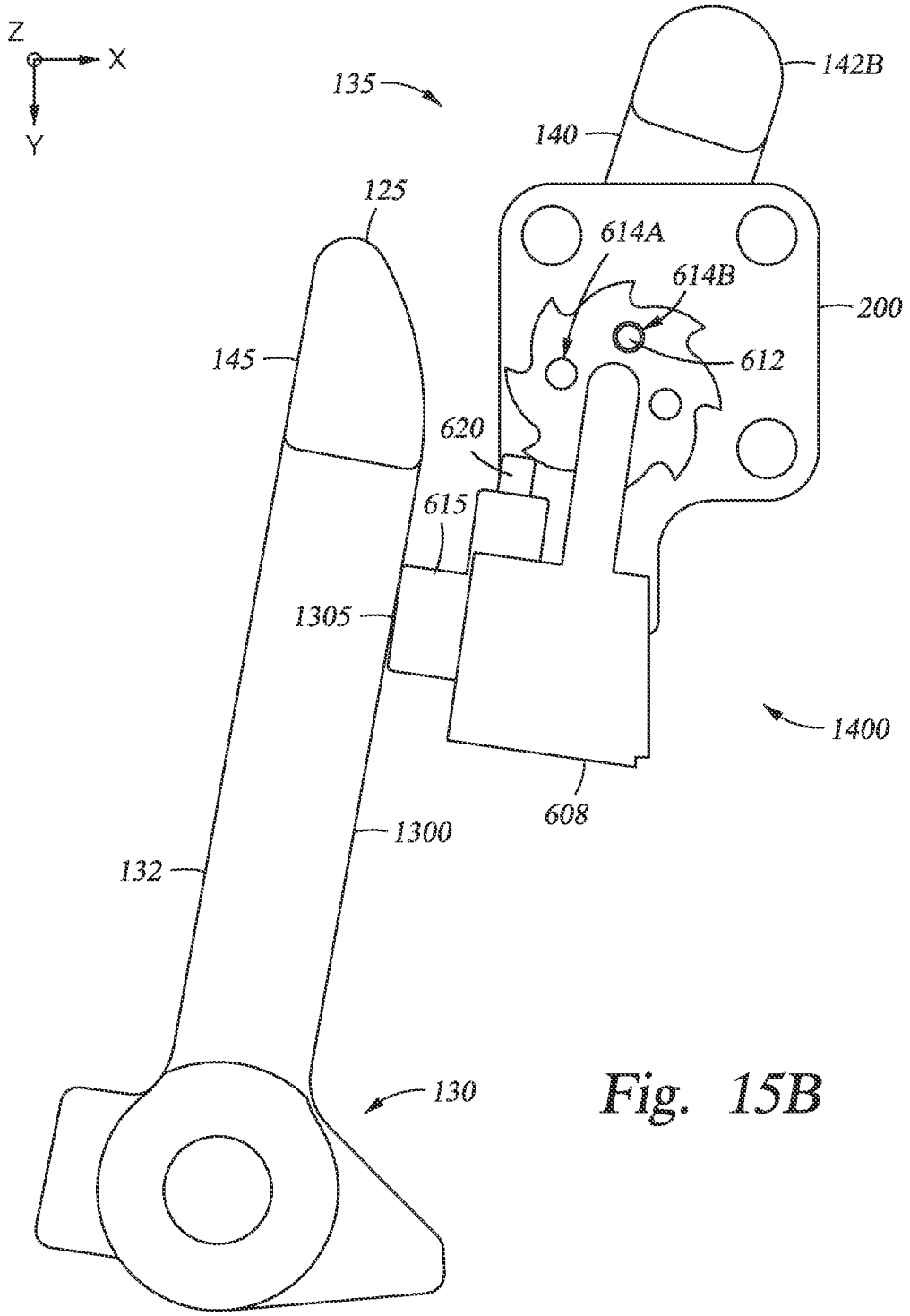
Figure 15C:
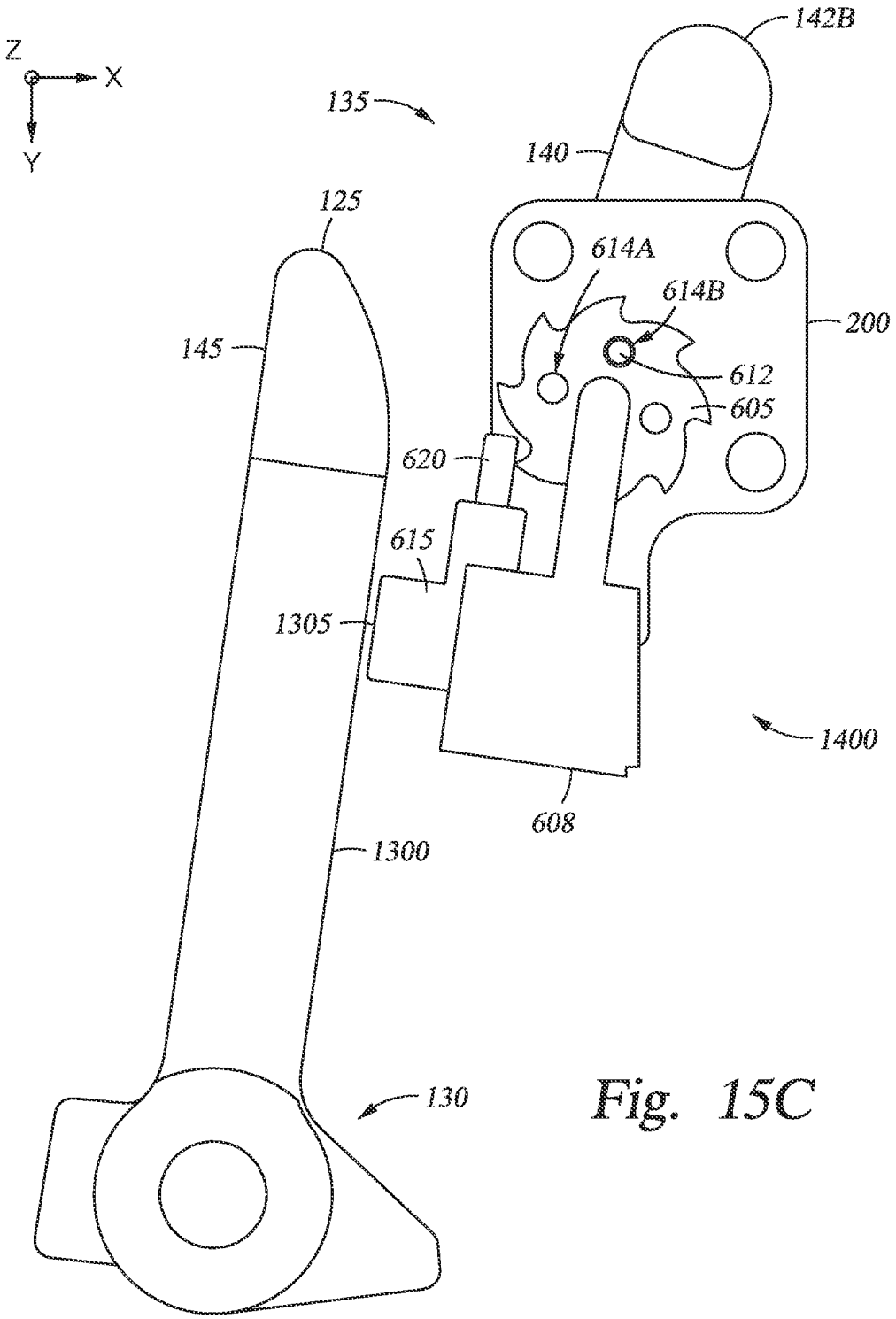
Figure 15D:
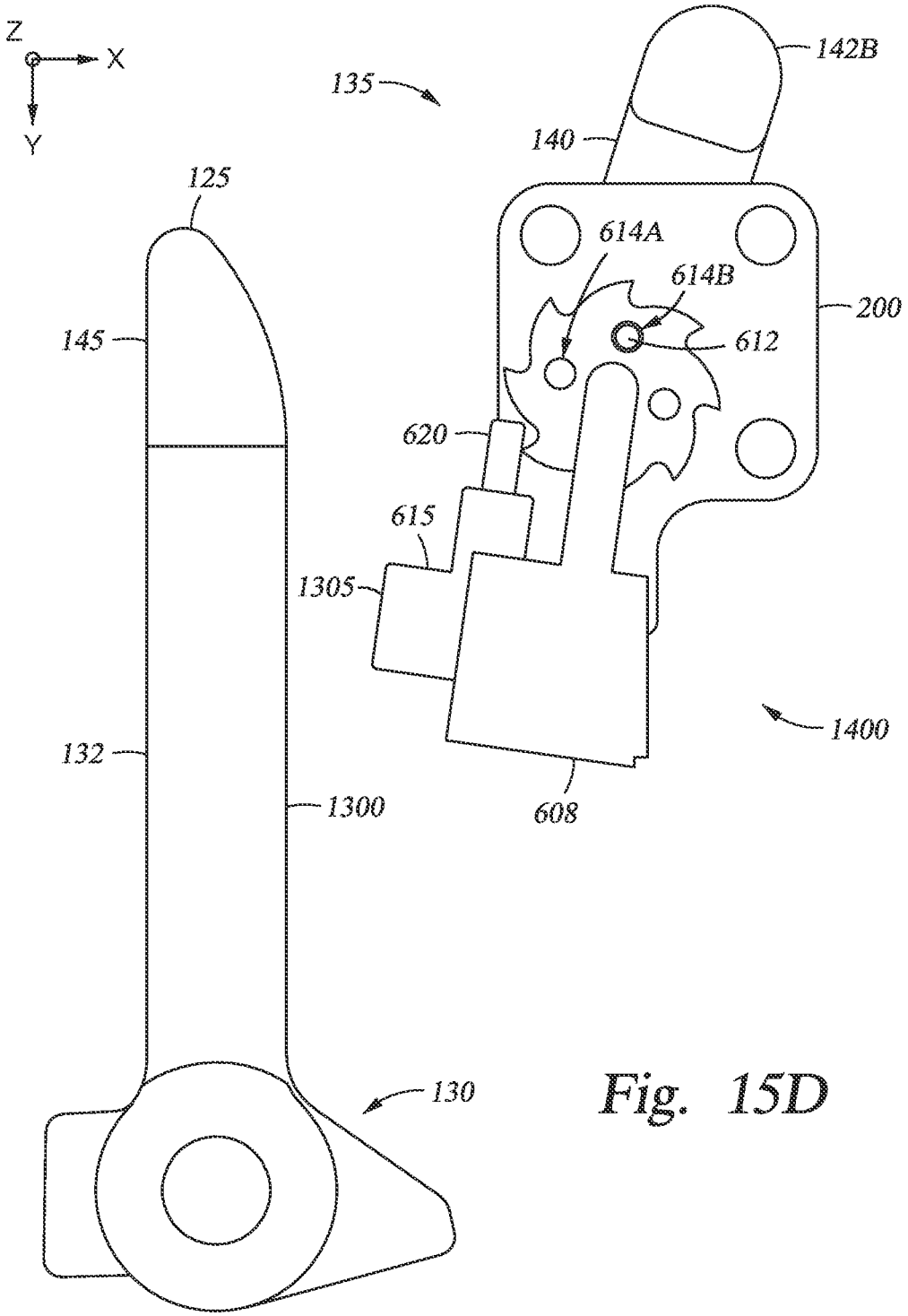
FIGS. 15D-15E are bottom views of the secondary latch lock assembly of FIG. 14 depicting a latch closing sequence.
Figure 15E:
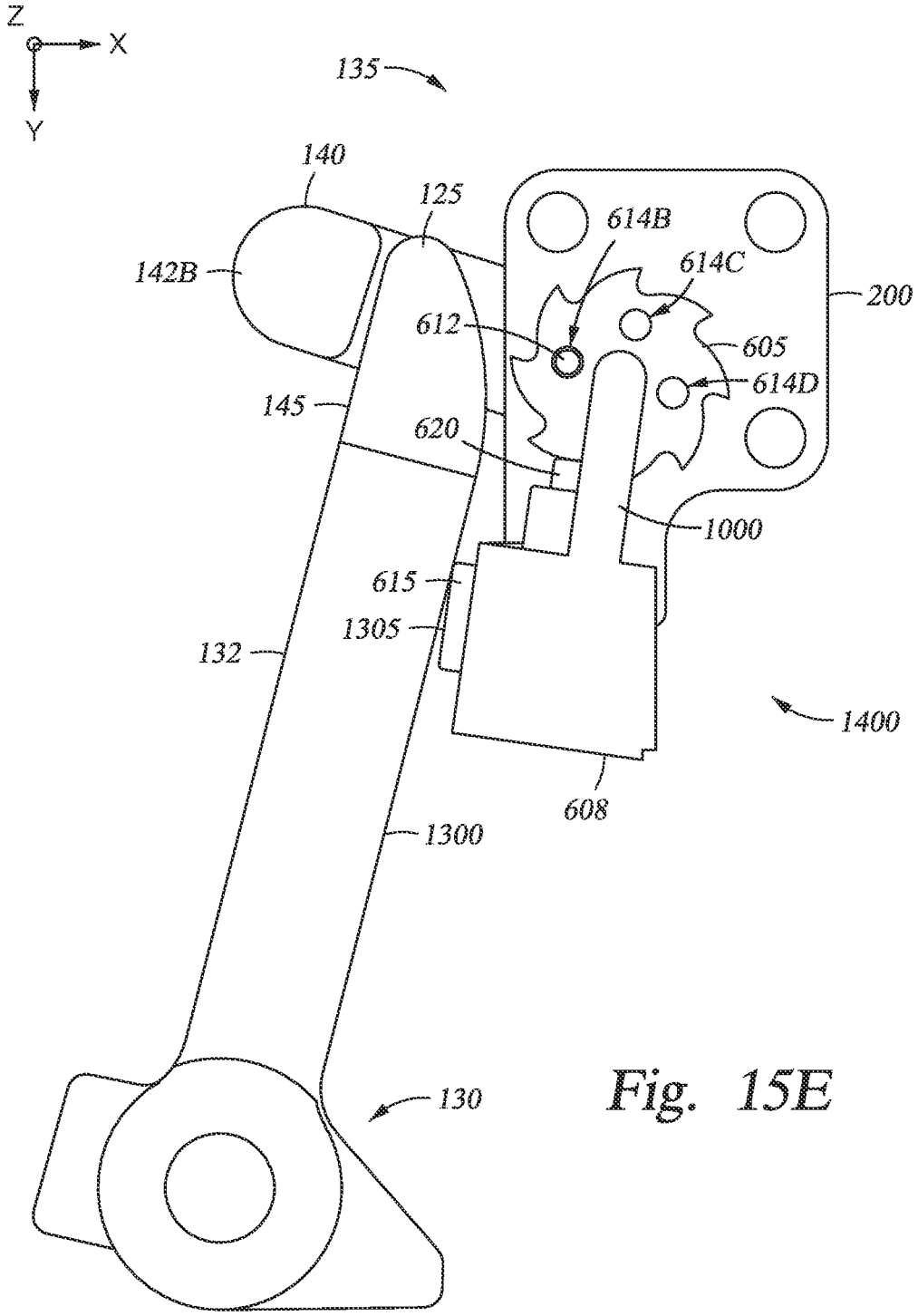

FIGS. 15A-15C are bottom views of the secondary latch lock assembly 1400 depicting a latch opening sequence. FIGS. 15D-15E are bottom views of the secondary latch lock assembly 1400 depicting a latch closing sequence.

FIG. 15A shows the latch plate 125 in a locked position. In this position, the handle 140 is engaged with the gear device 144 (shown in FIGS. 1-5) and secures the latch plate 125 to the door (not shown). The movable pin 620 is engaged with a tooth of the sprocket 605. The movable pin 620 is biased against the sprocket 605 by a biasing member (not shown) disposed in the striker device 615. The pin 612, which moves linearly (in the Z direction) as well as rotationally based on movement of the handle 140, is engaged with the first hole 614A in the sprocket 605.

FIG. 15B shows the position of the handle 140 that has been lifted and rotated counterclockwise approximately 90 degrees. This allows the latch plate 125 to move away from the secondary latch lock mechanism 135. As the latch plate 125 is moved away, the striker device 615 moves in the X direction, which allows the movable pin 620 to slide relative to the sprocket 605 based on the shape of the teeth of the sprocket 605. Movement of the handle 140 also causes the pin 612 to disengage from the first hole 614A and engage the second hole 614B of the sprocket 605.

FIG. 15C shows the latch plate 125 moved further away from the automated safety latch lock 600. The striker device 615 is fully extended from the housing 608. In this position, the striker device 615 may contact a stop (not shown) coupled to the housing 608, which prevents the striker device 615 from moving too far out of the housing 608. As shown in FIG. 15C, the movable pin 620 is fully extended from the body of the striker device 615 and is in position to engage a tooth of the sprocket 605 to facilitate reengagement of the secondary latch lock mechanism 135 during a closing sequence.

FIG. 15D shows the secondary latch lock assembly 1400 in a position to reengage the handle 140 during a closing sequence. As the latch plate 125 is moved in the X direction toward the striker device 615 during a closing sequence, the inner surface 1300 of the latch plate 125 contacts the side 1305 of the striker device 615. Movement of the latch plate 125 in the X direction causes the striker device 615 to move in the X direction. As the striker device 615 moves in the X direction, the movable pin 620 contacts a tooth of the sprocket 605. Continued movement of the striker device 615 causes the sprocket 605 to rotate counterclockwise. As the handle 140 is coupled to the sprocket 605 by the pin 612 disposed in the second hole 614B, the handle 140 will rotate counterclockwise.

FIG. 15E shows the secondary latch lock assembly 1400 in the closed position. In this position, the pin 612 is engaged with the second hole 614B of the sprocket 605. During a subsequent opening sequence as described in FIG. 15B, the pin 612 will disengage with the second hole 614B of the sprocket 605 and engage with a third hole 614C of the sprocket 605 based on movement of the handle 140.

Embodiments of the secondary latch lock mechanism 135 described herein provide a secure fastening means for safely locking a latch plate 125 of an elevator. The secondary latch lock mechanism 135 requires one-handed operation which frees the operators other hand to perform other tasks. The secondary latch lock mechanism 135 does not have parts (e.g. pins) that may be lost or require chains or cables as a fastening means to the elevator, which may cause injuries or other accidents. As the handle 140 of the secondary latch lock mechanism 135 as described herein is more clearly seen by the operator in position over the latch plate 125, the secondary latch lock mechanism 135 also adds value as a positive visual indicator to the operator that the latch plate 125 is locked (e.g., as opposed to pins that may be used in conventional latch locks that may be hard for an operator to see). Embodiments of the secondary latch lock mechanism 135 also include an automated closing feature which further increases the efficient operation of the elevator as well as providing additional safety to personnel.

While the foregoing is directed to embodiments of the invention, other and further embodiments of the invention may be devised without departing from the basic scope thereof, and the scope thereof is determined by the claims that follow.

The invention claimed is:

1. A secondary latch lock mechanism for an elevator having a primary safety latch, the secondary latch lock mechanism comprising:

a base portion that is fixed to a body of the elevator; and a handle movably fixed to the base portion and a first gear device by a biasing member, wherein the handle is movable to a first position proximate to the primary safety latch and a second position that is spaced away from the primary safety latch.

2. The secondary latch lock mechanism of claim 1, wherein the first gear device prevents movement of the handle from the first position to the second position.

3. The secondary latch lock mechanism of claim 2, wherein the first gear device comprises a plurality of teeth.

4. The secondary latch lock mechanism of claim 3, wherein the handle includes a pin that is biased against a portion of the plurality of teeth in the first position.

5. The secondary latch lock mechanism of claim 2, wherein the handle comprises a first end and a second end, and the second end comprises a protruded portion that prevents movement of the primary safety latch when the handle is in the first position.

6. The secondary latch lock mechanism of claim 2, further comprising:

a second gear device coupled to the handle.

7. The secondary latch lock mechanism of claim 6, wherein the second gear device comprises a sprocket and a pin.

8. The secondary latch lock mechanism of claim 7, wherein the sprocket includes a plurality of holes that selectively engage with the pin.

9. The secondary latch lock mechanism of claim 7, wherein the second gear device comprises a striker mechanism that selectively engages with the sprocket.

10. A secondary latch lock mechanism for an elevator having a primary safety latch, the secondary latch lock mechanism comprising:

a base portion that is fixed to a body of the elevator; and a handle movably fixed to the base portion, wherein the handle is adapted to selectively engage with a first gear device disposed on a first side of the base portion, and a second gear device disposed on an opposing second side of the base portion.

11. The secondary latch lock mechanism of claim 10, wherein the handle is movable to a first position proximate to the primary safety latch and a second position that is spaced away from the primary safety latch, and the first gear device prevents movement of the handle from the first position to the second position.

12. The secondary latch lock mechanism of claim 11, wherein the second gear device comprises a striker mechanism that is adapted to selectively engage with a sprocket.

13. The secondary latch lock mechanism of claim 12, wherein the striker mechanism is free to move away from the sprocket when the handle is in the second position.

14. The secondary latch lock mechanism of claim 13, wherein the striker mechanism engages the sprocket during movement of the primary safety latch toward the body of the elevator.

15. The secondary latch lock mechanism of claim 13, wherein the sprocket is engaged with a pin that is coupled to the handle, and the handle is moved to the first position during movement of the primary safety latch toward the body of the elevator.

16. A method for selectively securing a primary safety latch coupled to an elevator, the method comprising:

moving the primary safety latch from an open position to a closed position;

moving a handle coupled to the elevator by lifting and rotating the handle to a first position proximate a first surface of the primary safety latch, the first position preventing the primary safety latch from moving to the open position; and moving the handle to a second position that is spaced away from the first surface of the primary safety latch, the second position allowing movement of the primary safety latch to the open position.

17. The method of claim 16, wherein moving the primary safety latch from the open position to the closed position rotates the handle to the first position.

18. The method of claim 16, wherein the handle is coupled to a sprocket that is selectively engageable with a striker device, and during movement of the primary safety latch from the open position to the closed position, a second surface of the primary safety latch contacts the striker device.

19. The method of claim 18, wherein contact of the striker device with the sprocket causes rotation of the sprocket.

20. The method of claim 19, wherein the handle is coupled to the sprocket, and the handle rotates with the sprocket to the first position.

21. The method of claim 18, wherein the sprocket is engaged with a pin that is coupled to the handle, and the handle rotates to the first position during movement of the primary safety latch toward the body of the elevator.

22. The method of claim 16, further comprising:

locking the handle in the first position.

* * * * *